US010226783B2

(12) United States Patent
Han de Man et al.

(10) Patent No.: US 10,226,783 B2
(45) **Date of Patent: *Mar. 12, 2019**

(54) PUMP DEVICE AND METHODS FOR MAKING THE SAME

(75) Inventors: Eelco Han de Man, Vlijmen (NL); Stefan Koster, Rotterdam (NL)

(73) Assignee: Silgan Dispensing Systems R&D Netherlands B.V., Waalwijk (NL)

( * ) Notice: Subject to any disclaimer, the term of this patent is extended or adjusted under 35 U.S.C. 154(b) by 198 days.

This patent is subject to a terminal disclaimer.

(21) Appl. No.: 12/912,241

(22) Filed: Oct. 26, 2010

(65) Prior Publication Data

US 2011/0031278 A1 Feb. 10, 2011

Related U.S. Application Data

(63) Continuation-in-part of application No. PCT/US2010/029140, filed on Mar. 30, 2010.
(Continued)

(51) Int. Cl.

| | |
|---|---|
| ***B05B 11/00*** | (2006.01) |
| ***B05B 1/30*** | (2006.01) |
| ***B05B 1/32*** | (2006.01) |
| ***B05B 12/08*** | (2006.01) |
| ***F04B 45/02*** | (2006.01) |

(52) U.S. Cl.
CPC ..... *B05B 11/3032* (2013.01); *B05B 1/306* (2013.01); *B05B 1/323* (2013.01); *B05B 1/326* (2013.01); *B05B 11/0035* (2013.01); *B05B 11/0067* (2013.01); *B05B 11/3033* (2013.01); *B05B 11/3036* (2013.01); *B05B 11/3064* (2013.01); *B05B 12/088* (2013.01);
(Continued)

(58) Field of Classification Search
USPC ..... 222/212, 213, 207, 96, 92, 495, 493; 137/514.13, 614.14; 417/472, 560, 567, 417/568
See application file for complete search history.

(56) References Cited

U.S. PATENT DOCUMENTS 1,254,011 A * 1/1918 Wadell, Sr. ..... 137/614.14
2,248,958 A * 7/1941 Christensen et al. ..... 222/442
(Continued)

FOREIGN PATENT DOCUMENTS

CH 680358 A5 8/1992
CN 2937092 Y 8/2007
(Continued)

OTHER PUBLICATIONS

International Search Report for PCT/US2010/029140 published as WO2010117754A3 on Oct. 14, 2010.
(Continued)

*Primary Examiner* — Patrick M Buechner
*Assistant Examiner* — Michael J Melaragno
(74) *Attorney, Agent, or Firm* — Barlow, Josephs & Holmes, Ltd.

(57) ABSTRACT

Bellow actuated pump devices for dispensing a product from a container may include a bellow and a base or a bellow, a base, and a valve having two or more valves wherein actuation of the bellow opens a discharge portion of the valve and dispenses a product and the de-actuation of the bellow opens an intake portion of the valve and refills the pump for the next actuation.

5 Claims, 20 Drawing Sheets

Related U.S. Application Data

(60) Provisional application No. 61/164,755, filed on Mar. 30, 2009.

(52) U.S. Cl.
CPC ..... *F04B 45/02* (2013.01); *B05B 11/00412* (2018.08); *B05B 11/3018* (2013.01)

(56) References Cited

U.S. PATENT DOCUMENTS

| | | | | | |
|---|---|---|---|---|---|
| 2,532,787 | A * | 12/1950 | Romyns | 222/442 | |
| 2,888,034 | A * | 5/1959 | Glegg | 137/512.4 | |
| 2,943,417 | A | 7/1960 | Greenspan | | |
| 3,130,877 | A * | 4/1964 | Miller | 222/207 | |
| 3,141,580 | A * | 7/1964 | Rogers | 222/213 | |
| 3,715,060 | A * | 2/1973 | Benson | 222/207 | |
| 3,752,366 | A | 8/1973 | Lawrence, Jr. | | |
| 3,987,938 | A | 10/1976 | Cooprider et al. | | |
| 4,168,020 | A | 9/1979 | Benson | | |
| 4,197,265 | A | 4/1980 | Burke | | |
| 4,210,263 | A * | 7/1980 | Bos | 222/449 | |
| 4,330,071 | A | 5/1982 | Ohlson | | |
| 4,394,936 | A | 7/1983 | Shavit | | |
| 4,773,569 | A * | 9/1988 | Larsson | 222/181.3 | |
| 4,798,226 | A * | 1/1989 | Struth | 137/512.4 | |
| 4,828,150 | A * | 5/1989 | Bottger | A47G 19/183 | 222/207 |
| 4,830,284 | A | 5/1989 | Maerte | | |
| 4,917,265 | A * | 4/1990 | Chiang | 222/52 | |
| 4,946,075 | A * | 8/1990 | Lundback | 222/181.3 | |
| 5,238,153 | A * | 8/1993 | Castillo et al. | 222/189.09 | |
| 5,518,147 | A * | 5/1996 | Peterson et al. | 222/153.07 | |
| 5,524,795 | A * | 6/1996 | Lee | 222/207 | |
| 5,730,327 | A * | 3/1998 | Stern | A47K 5/1209 | 222/105 |
| 5,842,616 | A * | 12/1998 | Ruscitti et al. | 222/321.3 | |
| 5,860,567 | A * | 1/1999 | Fuchs et al. | 222/105 | |
| 6,158,620 | A | 12/2000 | Polan | | |
| 6,241,122 | B1 | 6/2001 | Araki et al. | | |
| 6,286,725 | B1 * | 9/2001 | Gerber | 222/207 | |
| 6,419,117 | B1 | 7/2002 | Bosch | | |
| 6,971,553 | B2 * | 12/2005 | Brennan et al. | 222/207 | |
| 7,322,491 | B2 | 1/2008 | Py et al. | | |
| 7,891,583 | B2 * | 2/2011 | Sayers et al. | 239/327 | |
| 7,931,173 | B2 * | 4/2011 | Yuan | 222/207 | |
| 7,997,453 | B1 * | 8/2011 | Gallegos | 222/207 | |
| 8,360,287 | B2 * | 1/2013 | Ciavarella et al. | 222/372 | |
| 8,701,942 | B2 * | 4/2014 | Nilsson | A47K 5/1209 | 222/207 |
| 8,708,200 | B2 * | 4/2014 | Nilsson | A47K 5/1209 | 222/207 |
| 2002/0074359 | A1 * | 6/2002 | Weber | 222/209 | |
| 2004/0069815 | A1 * | 4/2004 | Masuda | 222/495 | |
| 2005/0087555 | A1 * | 4/2005 | Hatton et al. | 222/209 | |
| 2008/0116226 | A1 | 5/2008 | Py et al. | | |
| 2008/0156829 | A1 * | 7/2008 | Chen | 222/207 | |
| 2009/0183371 | A1 | 7/2009 | Mileti et al. | | |
| 2009/0285510 | A1 | 11/2009 | Huang | | |
| 2010/0320226 | A1 * | 12/2010 | Nilsson | 222/1 | |
| 2011/0031278 | A1 | 2/2011 | Han de Man | | |
| 2014/0147318 | A1 * | 5/2014 | Han De Man et al. | 417/472 | |

FOREIGN PATENT DOCUMENTS

| | | | | |
|---|---|---|---|---|
| DE | 29823309 | U1 | 8/1999 | |
| DE | 102005012506 | A1 | 1/2007 | |
| EP | 1886736 | A1 * | 2/2008 | B05B 11/00 |
| EP | 2251655 | A1 | 11/2010 | |
| FR | 2127774 | A5 | 10/1972 | |
| GB | 2150226 | A | 6/1985 | |
| JP | 63161152 | U | 10/1988 | |
| WO | WO9953388 | A1 | 10/1999 | |
| WO | WO2010089501 | A1 | 8/2010 | |
| WO | WO2010117754 | A2 | 10/2010 | |
| WO | WO2011099309 | A1 | 8/2011 | |

OTHER PUBLICATIONS

Yuan Jianjun [CN], "Abgabevorrichtung." DE102005012506, published Jan. 4, 2007.
Polypump Curacao Nv, "Pompe a diaphragme actionnee manuellement." FR2127774, published Oct. 13, 1972.
Yuan Jianjun [CN], "Pump for Liquid Dispensers." EP1886736, published Feb. 13, 2008.
Seaquist Perfect Dispensing, "Abgabevorrichtung." DE102005012506, published Jan. 4, 2007.
Polypump Curacao Nv, "Manual action diaphragm pump." FR2127774, published Oct. 13, 1972.
Unknown applicant., "Unknown Title." JP63161152, published Oct. 21, 1988.
Trevor Cunningham, "Fluid Regulator and Improvements Related Thereto." WO9953388, published Oct. 21, 1999.
Jacques Pozzi and Pierre Roy, "Self-cleaning Tip." WO2010089501, published Aug. 12, 2010.
Shuntaro Abe, "Fluid Storage Container and Lid Thereof." WO2011099309, published Aug. 18, 2011.
Eelco Han de Man, "Pump Device and Methods for Making the Same." WO2010117754, published Oct. 14, 2010.
International Search Report and Preliminary Report for PCT/US2011/057781 published on May 3, 2012.
European Search Report on EP11182255, published on Jan. 22, 2013.
International Search Report for PCT/US2012/065527 published on Feb. 14, 2013.

* cited by examiner

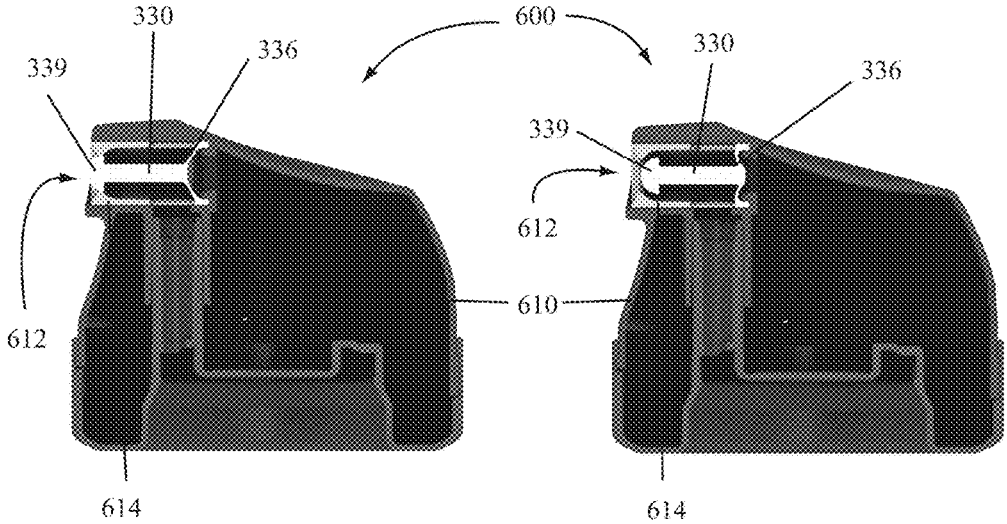
FIG. 31
FIG. 32
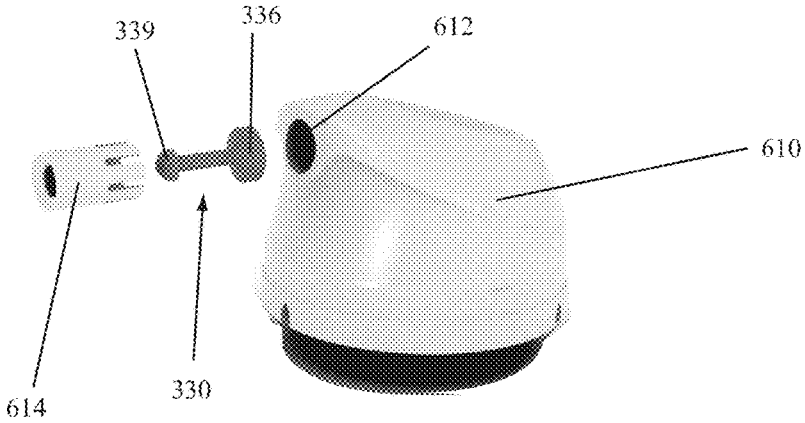
FIG. 33

PUMP DEVICE AND METHODS FOR MAKING THE SAME

CROSS-REFERENCE TO RELATED APPLICATIONS

This application is a continuation-in-part of PCT Application No. PCT/US10/29140, entitled "PUMP DEVICE AND METHODS FOR MAKING THE SAME," filed Mar. 30, 2010, which claims the benefit of U.S. Provisional Application No. 61/164,755, entitled "PUMP DEVICE AND METHODS FOR MAKING THE SAME," filed Mar. 30, 2009; each of these applications are incorporated herein by reference in their entireties.

BACKGROUND OF THE INVENTION

Field of the Invention

Embodiments of the invention relate to pump devices and more particularly, to pump devices utilizing a bellow mechanism for operating a pump device.

State of the Art

The personal and beauty care markets utilize a wide variety of different pump mechanisms and devices for delivering fluid-based products to a user. The pump devices include traditional pumps using ball valves or flap valves. Unique pump devices are also being developed to increase aesthetic value of the pump device or to provide new or improved functionality to the pump device or overall product package.

Typically, pumps or pump devices are connected to a bottle or other container holding a product. The product may be a fluid or a fluid mixed with solids or gases. The pump is used to deliver the product from the container to a user. In some instances, the container is a bottle and in other instances, the container may be a bag, a pouch, or a tube. In any event, it is often desirable that the pump evacuate most of the product from the container.

While many different pump devices exist, the desire for new pump devices to improve aesthetics or functionality or to reduce costs associated with producing and assembling the pumps, exists. Therefore, it may be desirable to develop new pump devices having fewer parts which are capable of meeting the desired specifications and requirements for delivering particular products.

BRIEF SUMMARY OF THE INVENTION

According to certain embodiments of the invention, a pump may include a base having a container attachment, an inlet passage, an interior chamber partially defined by a spacer integral with or separated from the base, and a discharge passage. A bellow having a bellow dome, bellow walls, a bellow rim, and a bellow chamber defined by the shape of the bellow dome and bellow walls may rest on the base rim in a portion of the interior space. The combination of the bellow chamber and interior chamber may define a pump chamber. The bellow walls may seal against a portion of the base to close or otherwise valve the inlet passage and a portion of the bellow rim contacting the base rim may close or otherwise valve the discharge passage. Actuation of the bellow dome may disperse product from the pump and de-actuation of the bellow dome may draw product into the pump chamber.

According to other embodiments of the invention, a pump may include a base, a valve, a bellow, and a cap. The valve may be positioned within an interior chamber of the base and valve walls may contact a base spacer to seal a pump chamber defined by the bellow and an interior portion of the base. A portion of the valve may also contact a portion of the bellow. Actuation of the bellow may displace or break the contact between the valve and the bellow, allowing product in the pump chamber to flow out of a discharge passage in the base. De-actuation of the bellow may lift the valve and may break a seal between the valve walls and a portion of the base, allowing product to flow through an inlet passage in the base into the pump chamber.

According to still other embodiments of the invention, a pump may include a base having an interior space, a valve positioned in the interior space of the base and secured therein by an attachment adapter, and a bellow attached to a portion of the base wherein the interior space of the base and an interior chamber of the bellow define a pump chamber. Actuation of the bellow may move a portion of the valve, allowing product in the pump chamber to escape through a discharge passage in the base. De-actuation of the bellow may seal the discharge passage with a portion of the valve and allow product to flow past a second portion of the valve from a container and into the pump chamber.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

FIG. 31 illustrates a cross-sectional view of a pump device according to embodiments of the invention;

FIG. 32 illustrates a cross-sectional view of a pump device according to embodiments of the invention;

FIG. 33 illustrates a pump device according to embodiments of the invention;

DETAILED DESCRIPTION OF THE INVENTION

According to embodiments of the invention, a pump may include a base and a bellow. The base and bellow may be fitted together or otherwise positioned to create or define a pump chamber between at least a portion of the base and the bellow whereby the bellow may be actuated to fill the pump chamber with a product and expel product from the pump chamber. The base may be attached to or otherwise in communication with a product source, such as in communication with a container containing a product. Actuation and release of the bellow may pump a product from the container, through the pump chamber, and out of the pump, thereby delivering the product to a user.

According to other embodiments of the invention, a pump may include a base, a bellow, and a valve. The base may be in communication with a container containing a product and fitment of the bellow with the base and the valve may create or define a pump chamber between the base and bellow or the valve and bellow. Actuation and release of the bellow may pump a product from the container, through the valve into the pump chamber, and out of the pump, thereby delivering the product to a user.

Figure 1:
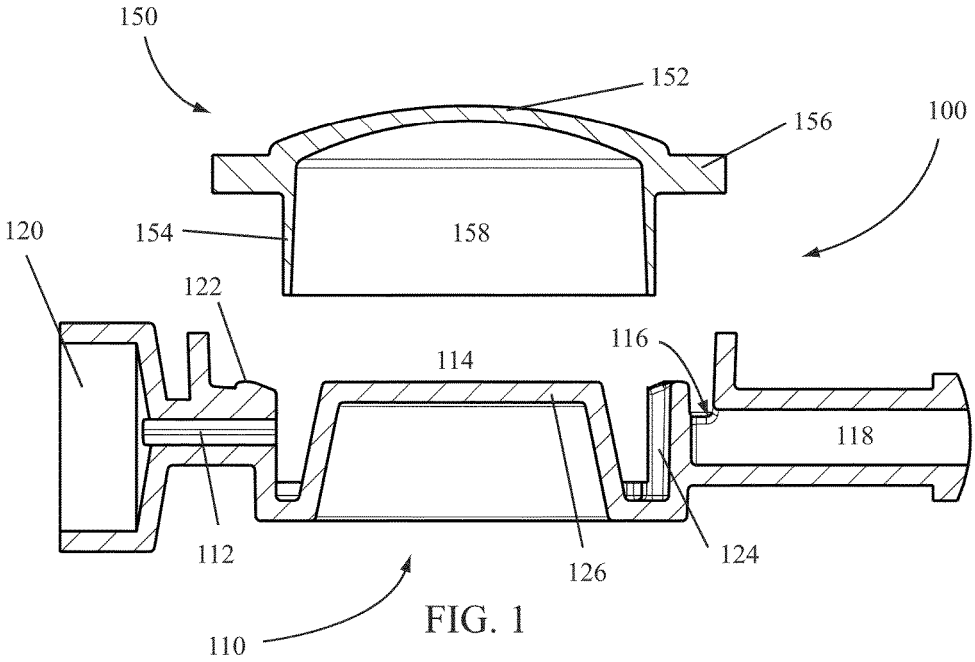
FIG. 1 illustrates a cross-sectional view of pump components for a pump according to various embodiments of the invention.

A pump 100 and components of a pump 100 according to various embodiments of the invention are illustrated in FIGS. 1 through 5. As illustrated in FIG. 1, a pump 100 may include a base 110 and a bellow 150.

The base 110 of a pump 100 according to various embodiments of the invention may include any one or more of an inlet passage 112, an interior chamber 114, an outlet 116, and a discharge passage 118. The base 110 may also include a container attachment 120. A base rim 122 may ring at least a portion of the interior chamber 114 of the base 110. Product passageways 124 may also be configured in a portion of the interior chamber 114 of the base 110. A spacer 126 formed in the base 110 may define the volume within the interior chamber 114 of the base 110. The base 110 may be constructed or made of any desirable material, and in some embodiments, the base 110 may be formed from a moldable plastic or resin material.

Figure 2:
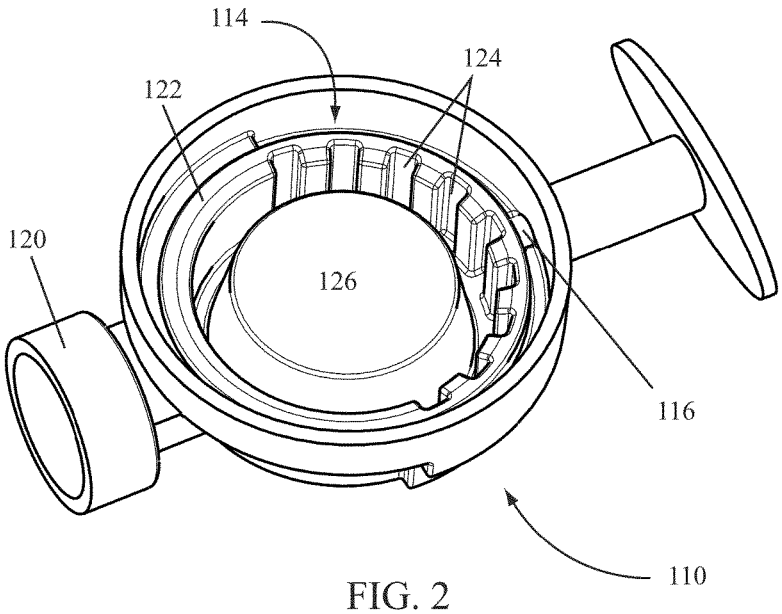
FIG. 2 illustrates a perspective view of a base of a pump according to various embodiments of the invention.

A perspective view of a base 110 of a pump 100 according to various embodiments of the invention is illustrated in FIG. 2. As illustrated, the container attachment 120 may be circular in shape. In other embodiments, the container attachment 120 may be configured or shaped as desired to communicate with a container or product source. An inlet passage 112 connects an interior portion of the container attachment 120 with the interior chamber 114 of the base 110. Product from a container may flow through the inlet passage 112 into the interior chamber 114. A spacer 126 formed in the base 110 may partially define the volume within the interior chamber 114 of the base 110. As desired, the spacer 126 may be configured or shaped to provide a desired volume within the interior chamber 114. A base rim 122 may encompass at least a portion of the interior chamber 114. One or more product passageways 124 may be formed in the interior chamber 114 of the base 110. An outlet 116 may provide communication between the interior chamber 114 of the base 110 and a discharge passage 118 of the base 110.

A bellow 150 according to various embodiments of the invention may include a bellow dome 152, bellow walls 154, one or more bellow rims 156 and an interior bellow chamber 158 as illustrated in FIG. 1. The bellow 150 may be shaped such that it may fit within a portion of the interior chamber 114 of the base 110. A bellow 150 according to various embodiments of the invention may be made from silicon, thermoplastic polyurethane (TPU), thermoplastic elastomer (TPE), or other material as desired.

Figure 3:
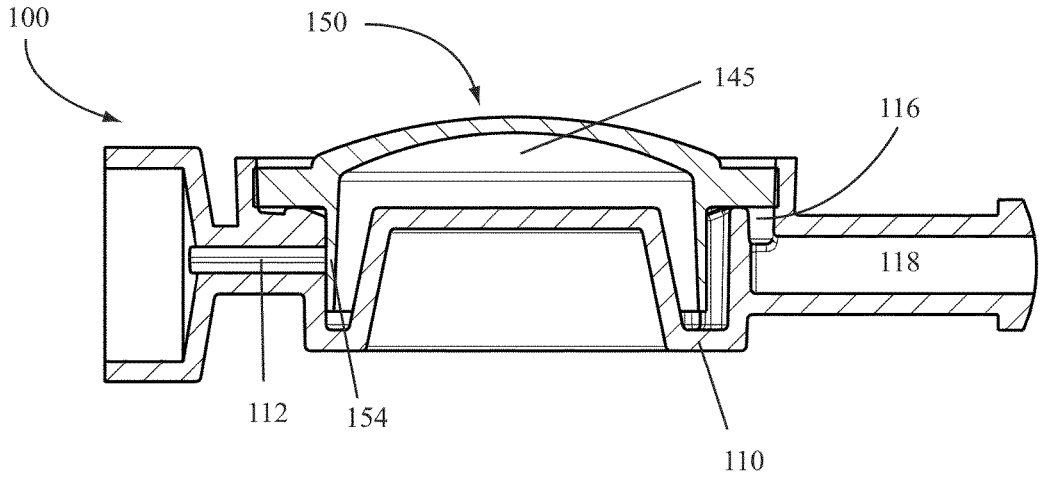
FIG. 3 illustrates a cross-sectional view of a pump according to embodiments of the invention.

FIG. 3 illustrates an assembled pump 100 according to various embodiments of the invention. As illustrated, a bellow 150 may be fitted with the base 110 to form a pump chamber 145 within the pump 100. The pump chamber 145 may be the combined space within the interior chamber 114 of the base 110 and the bellow chamber 158. As illustrated in FIG. 3, when the bellow 150 is fitted with the base 110, the bellow walls 154 may seal against an interior wall of the base 110 thereby closing off the inlet passage 112 from the pump chamber. The bellow 150 may also sit or rest within the base 110 such that the one or more bellow rims 156 are in contact with the base rim 122. The pump chamber 145 includes the space between the bellow chamber 158 and the interior chamber 114 of the base 110. In some embodiments of the invention, the bellow walls 154 do not reach a floor of the interior chamber 114 of the base 110, thereby leaving some room between the floor of the interior chamber 114 of the base 110 and the bottom of the bellow walls 154. In such instances, the pump chamber 145 may also include the space between an exterior of the bellow walls 154 and the one or more product passageways 124 in the base 110. The one or more product passageways 124 may provide a passage from the interior chamber 114 of the base 110 outside of the bellow walls 154 and up to a portion of the bellow rim 156 contacting the base rim 122. The interface or contact between the bellow rim 156 and a portion the base rim 122 may close the outlet 116 and isolate the pump chamber 145.

According to some embodiments of the invention, the base 110 may include a lip overhanging portion into which the bellow rim 156 may fit such that the lip overhanging portion is above the upper portion of the bellow rim 156 and may facilitate fitment of the bellow 150 with the base 110. In other embodiments of the invention, a cap may be secured to the base 110 with the bellow 150 between the cap and the base 110. Other methods for securing or fitting the bellow 150 and base 110 together may also be used as desired.

Figure 4:
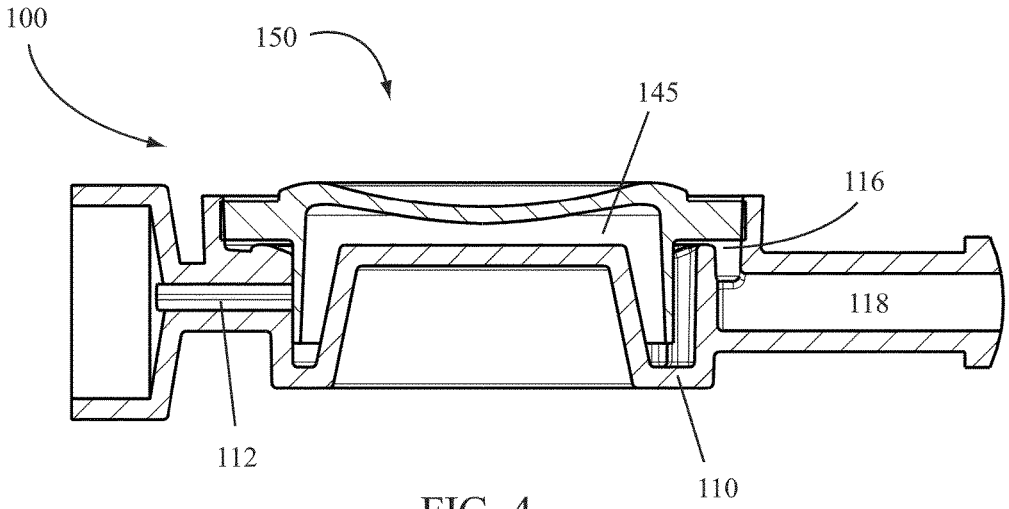
FIG. 4 illustrates a cross-sectional view of a pump according to embodiments of the invention.

A force applied to the bellow 150 may deform the bellow 150 as illustrated in FIG. 4. The deformation of the bellow 150, or application of a force to the bellow dome 152, applies a force to a fluid or gas contained within the pump chamber 145. The force applied to the fluid or gas in the pump chamber 145 may be sufficient to raise at least a portion of the one or more bellow rims 156. When the portion of the bellow rim 156 overlying the outlet 116 is raised or moved, fluid or gas from within the pump chamber 145 may flow through the outlet 116 and escape through the discharge passage 118.

When the force applied to the bellow 150 subsides or is released, pressure on the fluid or gas in the pump chamber 145 may be reduced and the bellow rim 156 may return to a position wherein the outlet 116 is again blocked. In addition, when the force on the bellow dome 152 is released, the bellow dome 152 may return to its original shape. The return of the bellow dome 152 to its original shape may draw a vacuum or create a reduced pressure within the pump chamber 145. The vacuum or reduced pressure may assist to pull the bellow rim 156 over the outlet 116 and to seal the outlet 116. In addition, the vacuum or reduced pressure may break the seal between the bellow walls 154 and the inlet passage 112, allowing fluid or product from a container to be pulled through the inlet passage 112 and into the pump chamber 145. In this manner, the pump chamber 145 may be primed or filled with a product which may then be evacuated by actuation of the bellow 150.

Figure 5:
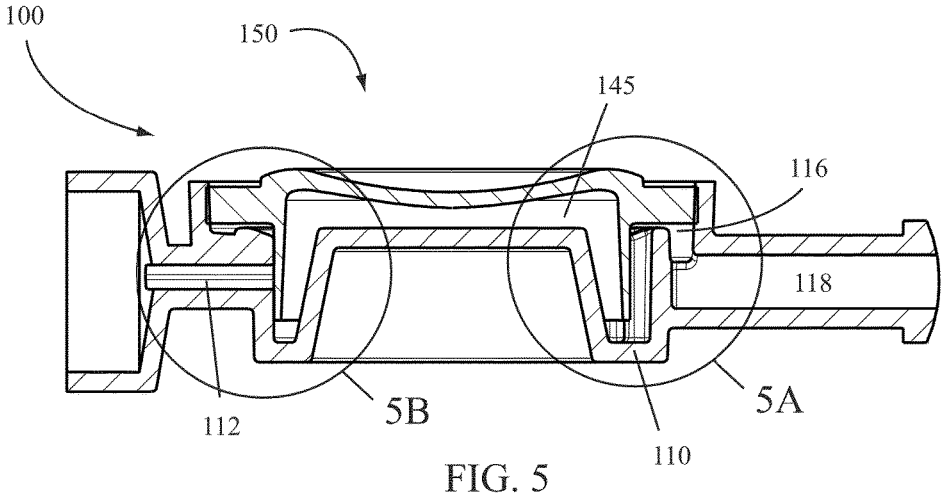
FIG. 5 illustrates a cross-sectional view of the pump of FIG. 4 showing detail portions.
Figure 5A:
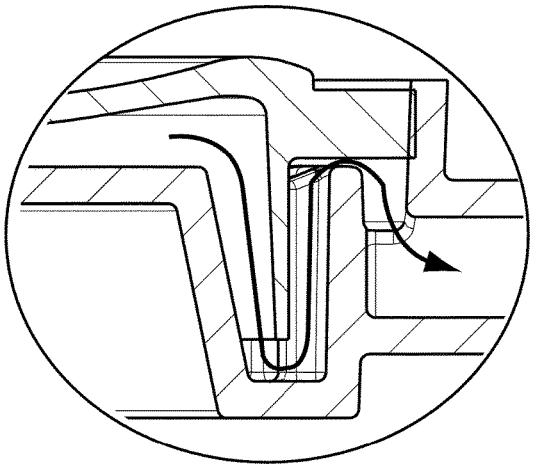
FIGS. 5A and 5B illustrates enlarged cross-sectional views of the pump illustrated in FIG. 5.
Figure 5B:
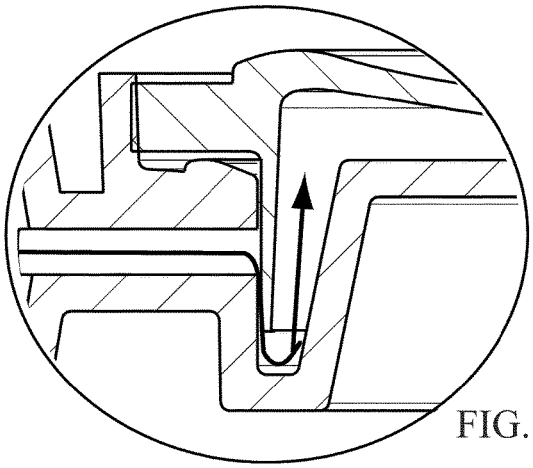

FIGS. 5, 5A and 5B illustrate a fluid flow path through a pump 100 according to various embodiments of the invention. As illustrated in FIG. 5, a force has been applied to the bellow dome 152, deforming the bellow dome 152 and applying a force to fluid or other product in the pump chamber 145. As force is applied to the bellow dome 152, product in the pump chamber is forced out of the pump chamber 145, through product passageways 124, through outlet 116, and out the discharge passage 118 as illustrated by the product flow arrow in FIG. 5A. When the force on the bellow dome 152 is released and the bellow dome 152 begins to return to its original shape, product flows through inlet passage 112, around bellow walls 154, and into the pump chamber 145 as illustrated by the product flow arrow in FIG. 5B.

Operation of a pump 100 as illustrated in FIGS. 1 through 5 may be accomplished by actuating bellow dome 152. Repeated actuation of the bellow dome 152 may prime the pump 100, draw product into the pump chamber 145, and allow a user to dispense the product through the pump 100 for any desired use.

According to other embodiments of the invention, a pump 200 may include various components as illustrated in FIGS. 6A through 6D.

Figure 6A:
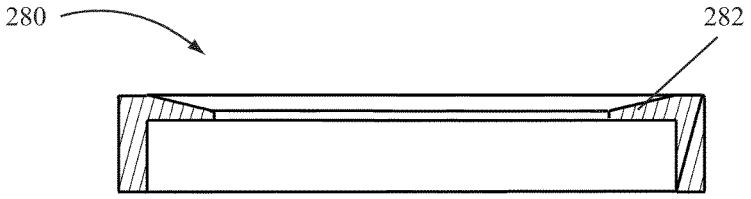
FIGS. 6A through 6D illustrate cross-sectional views of various components of a pump according to various embodiments of the invention.
Figure 6B:
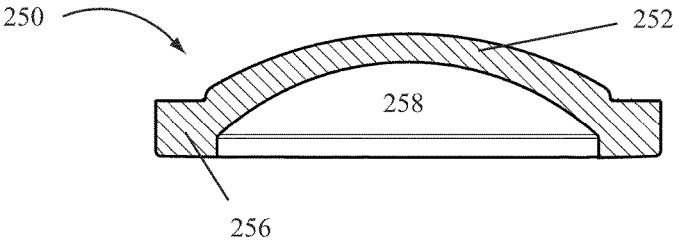
Figure 6C:
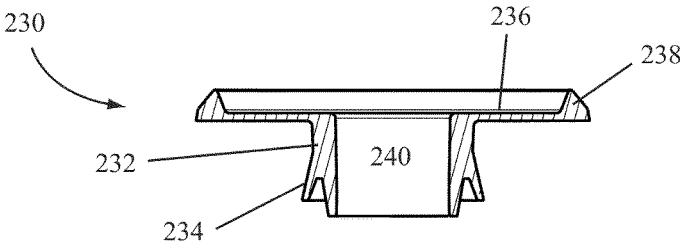
Figure 6D:
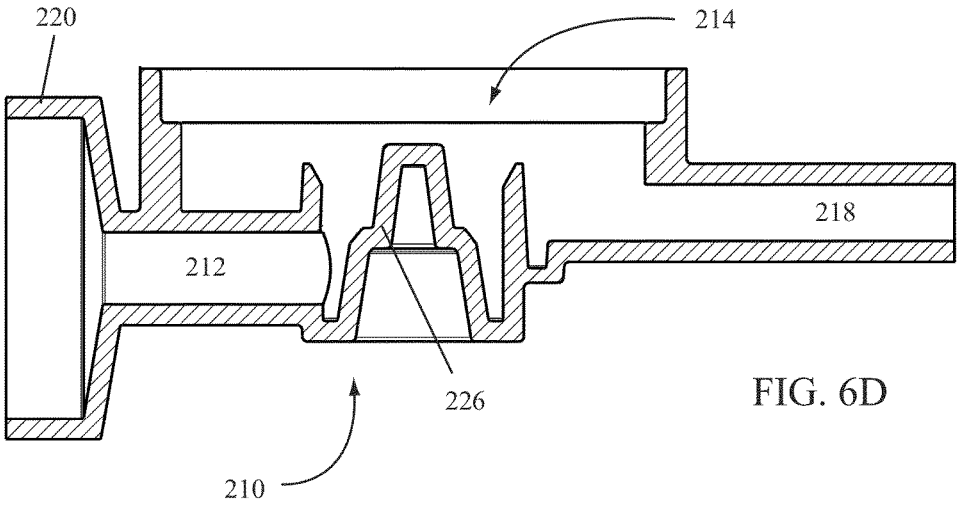

A base 210 of a pump 200 is illustrated in FIG. 6D. The base 210 may include a container attachment 220, an inlet passage 212, an interior chamber 214, a spacer 226, a base rim 222, and a discharge passage 218. The container attachment 220 may include any desired attachment device for attaching the base 210 or the pump 200 to a container such as a bottle, tube, bag, or pouch. The inlet passage 212 may allow a product to flow from a container into a portion of the interior chamber 214 of the base 210. The interior chamber 214 may include a volume which is partially defined by the spacer 226. The shape, size, dimensions and other specifications of the spacer 226 may be altered or modified to generate a desired volume, shape, or size within the interior chamber 214 of the base 210. One or more base rims 210 or other support structures for supporting other components of the pump 200 may also be included in the base 210. Product flowing through at least a portion of the interior chamber 214 may exit the base 210 through the discharge passage 218.

According to various embodiments of the invention, the base 210 may be molded as a single piece or component. In other embodiments, the base 210 may include two or more pieces or components. The base 210 may be molded or formed from any desirable material, including, for example, a resin material or a plastic material which may be molded using conventional molding techniques.

A valve 230 for a pump 200 according to various embodiments of the invention is illustrated in FIG. 6C. A valve 230 may include valve walls 232, a valve disc 236 in communication with the valve walls 232 and a valve rim 238 located on of the valve disc 236. One or more valve flanges 234 may extend outwards from the valve walls 232.

According to various embodiments of the invention, a valve 230 as illustrated in FIG. 6C may include valve walls 232 defining a valve chamber 240 or passage through the valve 230. A lower valve flange 234 may extend outwards from the valve walls 232. A valve disc 236 may circumscribe an upper portion of the valve 230 about the valve walls 232. An opening in the valve disc 236 may correspond with the valve walls 232 such that a passage through the valve 230 is defined by the valve walls 232 and the opening in the valve disc 236. A valve rim 238 may project upwards or away from the valve disc 236. As illustrated in FIG. 6, the valve rim 238 may circumscribe the entire valve disc 236. Although the valve rim 238 illustrated in FIG. 6C is located on an outer portion of the valve disc 236, it is understood that the valve rim 238 may located anywhere desired on the valve disc 236.

A bellow 250 according to embodiments of the invention is illustrated in FIG. 6B. A bellow 250 may include a bellow dome 252, a bellow chamber 258, and a bellow rim 256. The bellow chamber 258 may be defined by the shape of the bellow dome 252. Thus, different sizes and shapes of the bellow chamber 258 may be created by altering the shape or size of the bellow dome 252.

The bellow 250 may be formed of any desired material. In some embodiments of the invention, the bellow 250 may be a material that may be deformed but which will return to its original shape after a force causing such deformation is removed. For example, the bellow 250 may be made of silicon, a TPE material, or a TPU material. The bellow dome 252 may be deformed to change the volume or shape of the bellow chamber 258. As the bellow dome 252 is deformed, the remainder of the bellow 250 may flex or deform in a corresponding manner as desired.

A cap 280 according to various embodiments of the invention is illustrated in FIG. 6A. A cap 280 may include a cap flange 282. According to various embodiments of the invention, a cap 280 may be attachable to the base 210 or to another portion of a pump 200 to keep the various components of a pump 200 assembled. For example, the cap 280 illustrated in FIG. 6A may be positioned over a bellow 250 and a base 210 to secure the bellow 250 in an appropriate position with respect to the base 210. A cap 280 according to various embodiments of the invention may include any desired means for securing the cap 280 to the base 210 or other portion of the pump 200. For instance, the cap 280 may be screwed onto the base 210, may frictionally fit to the base 210, may be welded or glued to the base 210 or may be snapped onto the base 210. In various embodiments, the base 210 may include features which assist with the connection of the cap 280 to the base 210, such as corresponding lugs, screw channels, or other features needed to secure the cap 280 to the base 210.

Figure 7:
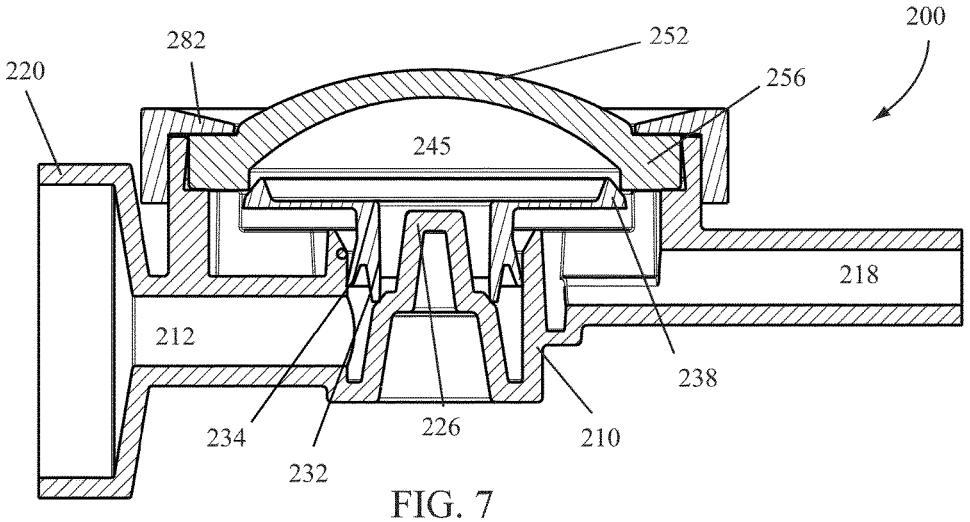
FIG. 7 illustrates a cross-sectional view of a pump according to various embodiments of the invention.

A pump 200 according to various embodiments of the invention may include a base 210, a valve 230, a bellow 250 and a cap 280 fitted together as illustrated in FIG. 7. The valve 230 may fit within the interior chamber 214 of the base 210 such that an inner portion of the valve walls 232 rest on or come into contact with the spacer 226. A portion of the valve flange 234 may also contact a portion of the base 210. The contact between the valve flange 234 and the base 210 may close off the inlet passage 212 from a pump chamber 245 formed from a portion of the interior chamber 214 of the base and the bellow chamber 258. The bellow 250 may rest on or contact the base rim 222 as illustrated in FIG. 7. In other embodiments, the bellow 250 may be supported on or within the base 210 using any desired means. A portion of the bellow rim 256 may contact the valve rim 238. A pump chamber 245 is defined within the space formed by the base 210, the valve chamber 240 and the bellow chamber 258. As illustrated in FIG. 7, the pump chamber 245 is a closed volume when in rest. A cap 280 or other securing mechanism fitted over a portion of the bellow 250 and the base 210 may hold the pump 200 together. For example, as illustrated in FIG. 7, the cap 280 may fit over the base 210 and the cap flange 282 may extend over the bellow 250 which rests on the base rim 222. The cap 280 may be secured to the base 210 and the cap flange 282 may hold the bellow 250 and the valve 230 in a desired position for the pump 200.

Figure 8:
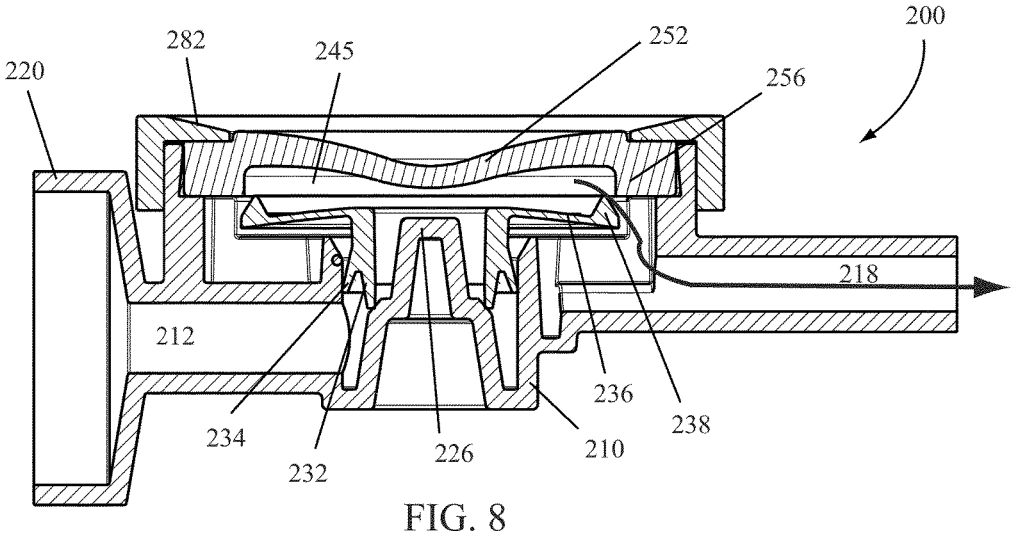
FIG. 8 illustrates a cross-sectional view of a pump according to various embodiments of the invention.
Figure 9:
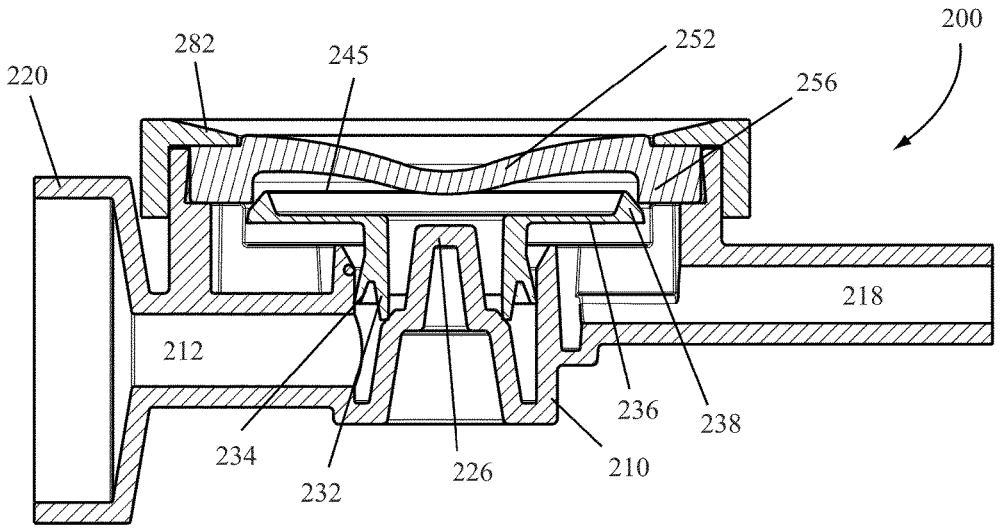
FIG. 9 illustrates a cross-sectional view of a pump according to various embodiments of the invention.
Figure 10:
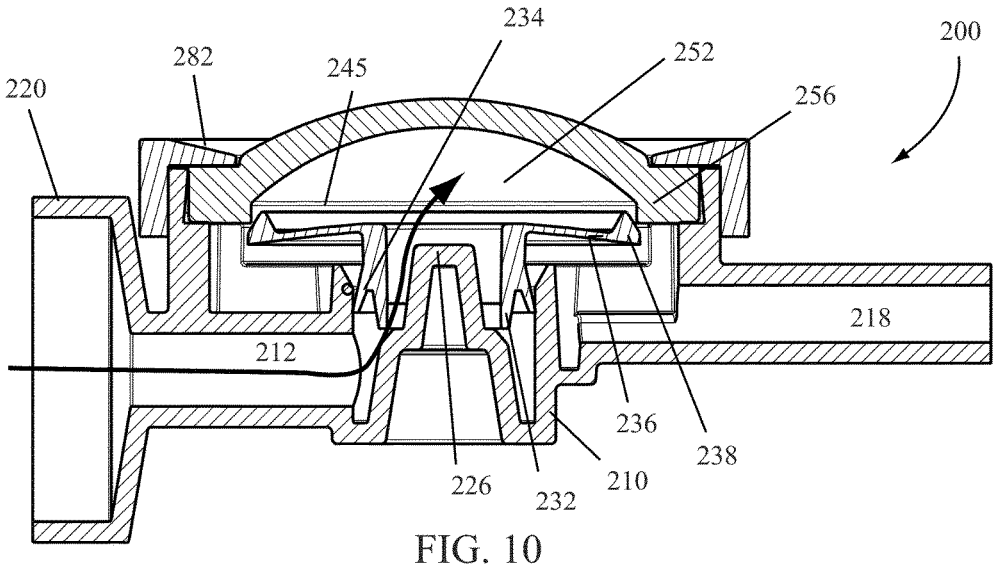
FIG. 10 illustrates a cross-sectional view of a pump according to various embodiments of the invention.

FIGS. 8 through 10 illustrate a pump 200 according to embodiments of the invention in operation. As illustrated in FIG. 8, a force may be applied to the bellow dome 252, thereby altering the volume and shape of the pump chamber 245. When such a force is applied to the bellow dome 252, a product stored in the pump chamber 245 applies a force to the valve 230 and particularly to the valve disc 236. As a result, the valve disc 236 may flex which may break the contact between the valve rim 238 and the bellow rim 256. If sufficient force is applied to the bellow dome 252 to break the contact between the valve rim 238 and the bellow rim 256 as illustrated in FIG. 8, product within the pump chamber 245 may escape from the pump chamber 245 and flow through the opening between the valve rim 238 and the bellow rim 256. For example, product may flow out of the pump chamber 245 in the direction of the arrow in FIG. 8 such that product escapes or exists the pump 200 through the discharge passage 218.

According to some embodiments of the invention, when a force is applied to the bellow dome 252 as illustrated in FIG. 8, a valve flange 234 in contact with a portion of the base 210 may help to maintain the contact between the valve walls 232 and the spacer 226 which may prevent a backflow of product through the valve walls 232 into the inlet passage 212.

FIG. 9 illustrates a pump 200 after the force being applied in FIG. 8 is released or after sufficient product has exited the pump chamber 245 such that a force is no longer applied to the valve disc 236. As illustrated, once the force within the valve chamber 245 is below the force required to flex the valve disc 236, the valve disc 236 may return to a position wherein the valve disc 236 is in contact with the bellow rim 256. In addition, the valve walls 232 maintain contact with the spacer 226. Thus, the pump chamber 245 is again sealed or closed.

Following the release of the force on the bellow dome 252, the bellow dome 252 may return to its original form or shape as illustrated in FIG. 10. As the bellow dome 252 retracts or moves back into its original position or shape, a vacuum may be formed within the pump chamber 245. The vacuum may act on the valve 230 such that the valve walls 232 are pulled away from contact with the spacer 226 as illustrated in FIG. 10. Once the valve walls 232 are separated from contact with the spacer 226, the vacuum in the pump chamber 245 may pull product from the inlet passage 212 into the pump chamber 245. In this manner, the pump chamber 245 may refill with product. When the bellow dome 252 has returned to its original shape or position, or when the vacuum force is insufficient to raise the valve 230, the valve walls 232 may again contact the spacer 226. This contact may stop the flow of product from the inlet passage 212 into the valve chamber 245 and the pump 200 may be back in the position illustrated in FIG. 7.

As illustrated in FIGS. 7 through 10, a product may be pumped through the pump 200 by actuating the bellow dome 252 of the pump 200. When actuated, product in the pump chamber 245 may be forced out of the pump chamber 245 and through the discharge passage 218. In some instances, the product may follow the path illustrated in FIG. 8. Upon reducing or ceasing actuation of the bellow dome 252, the bellow dome 252 may return to its original position, drawing product from a container attached to the pump 200 through the inlet passage 212 and into the pump chamber 245. For example, product may enter the pump chamber 245 along the path illustrated in FIG. 10. In this manner, a pump 200 may be actuated to dispense a product from a container attached to the pump 200.

Figure 16:
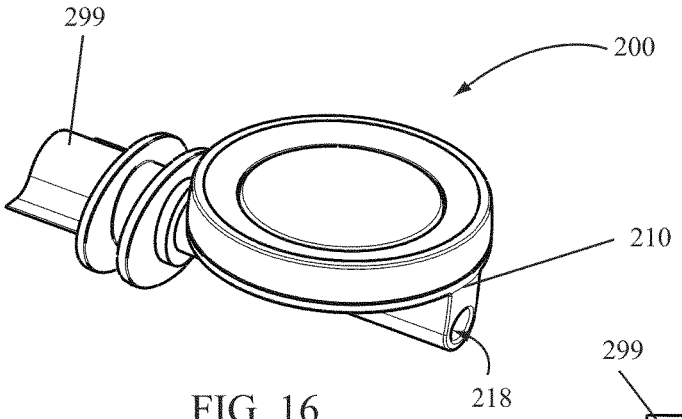
FIG. 16 illustrates a perspective view of a pump and container connection according to various embodiments of the invention.
Figure 17:
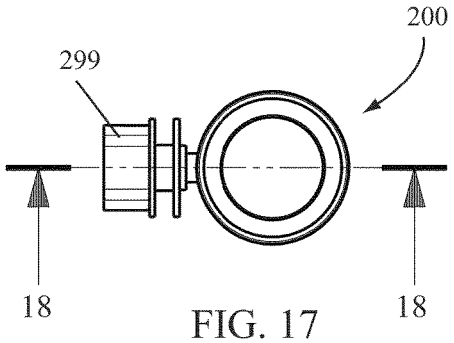
FIG. 17 illustrates a top-down view of a pump and container connection according to various embodiments of the invention.
Figure 18:
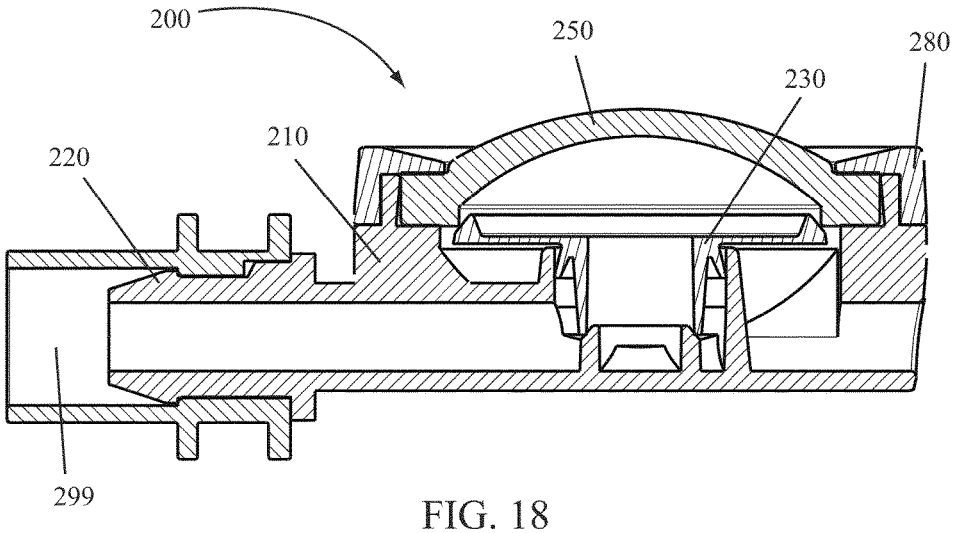
FIG. 18 illustrates a cross-sectional view of the pump illustrated in FIGS. 16 and 17.

An alternative embodiment of a pump 200 according to various embodiments of the invention is illustrated in FIGS. 16 through 18. FIG. 16 includes a perspective view of a pump 200 attached to a container connection 299. FIG. 17 illustrates a top-down view of the same pump 200 and container connection 299. FIG. 18 illustrates a cross-sectional view of the pump 200 as seen along cross-sectional line 18 illustrated in FIG. 17.

As illustrated in FIG. 18, a pump 200 may include a base 210 having a container attachment 220 integrated therewith. The container attachment 220 may mate with or otherwise fit with a container connection 299. For example, as illustrated in FIG. 18, the container attachment 220 may include a male fitment which mates with a female container connection 299. In other embodiments, the container connection 299 may be a male fitment which mates with a female container attachment 220. Regardless, the container connection 299 may include a connection integrated with a container—such as a bottle, pouch, bag or other container—or a connection providing communication between a container and the pump 200.

The pump 210 may include a base 210, a valve 230 and a bellow 250. In some embodiments a cap 280 may also be included. In particular embodiments, the cap 280 may be integrated with the base 210 or the bellow 250. In still other embodiments, a cap 280 may be omitted and the bellow 250 may fit with the base 210 as desired.

According to still other embodiments of the invention, a pump 300 may include various components as illustrated in FIGS. 11A through 11D.

Figure 11A:
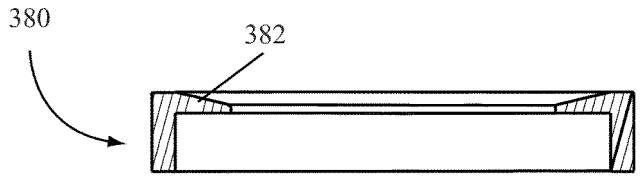
FIGS. 11A through 11D illustrate cross-sectional views of various components of a pump according to various embodiments of the invention.
Figure 11B:
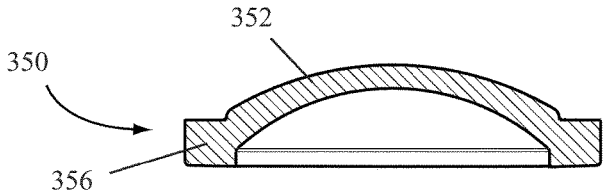
Figure 11C:
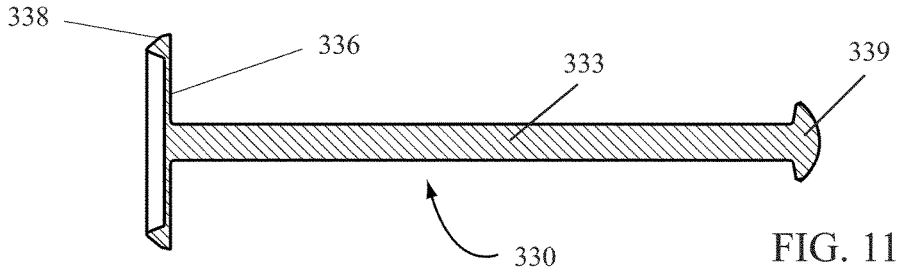
Figure 11D:
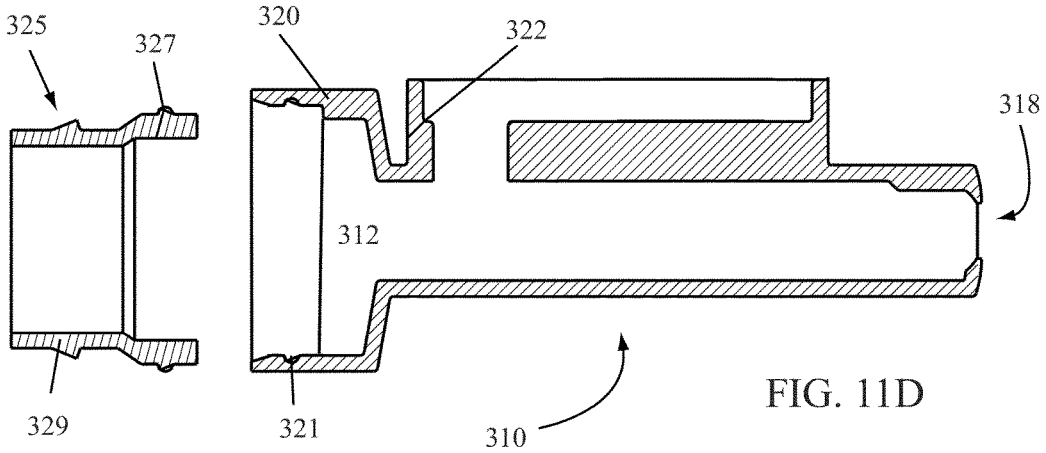

A pump 300 base 310 according to various embodiments of the invention is illustrated in FIG. 11D. The base 310 may include a container attachment 320, an inlet passage 312, an interior chamber 314, a base rim 322 and a discharge passage 318. The container attachment 320 may include any desired attachment device for attaching the base 310 or the pump 300 to a container such as a bottle, tube, bag, or pouch. In some embodiments of the invention, the container attachment 320 may also contain an attachment feature 321 for mating with or attaching to an attachment adapter 325. An attachment adapter 325 may include an adapter attachment feature 327 configured to mate with or otherwise attach to the attachment feature 321. An attachment adapter 325 may also include one or more connecter flanges 329. A connecter flange 329 may be used to attach to a container or to hold a container onto the attachment adapter 325 for assembly or mating to a pump 300. An adapter attachment 325 may also contact other parts of a pump 300 and may assist in assembling a pump 300.

An inlet passage 312 may allow a product to flow from a container into a portion of the interior chamber 314 of the base 310. The interior chamber 310 may include a hollow passage into which a valve 330 may fit or be seated. The shape, size, dimensions, and other features of the interior passage 345 may be altered or modified as desired. The base 310 or a portion of the interior chamber 345 may also include a base rim 322. The discharge passage 318 may be positioned opposite the inlet passage 312 or on the opposite side of the interior chamber 345 from the inlet passage 212. As illustrated in FIG. 11D, the discharge passage 318 may include an opening in the base 310.

According to various embodiments of the invention, the base 310 may be molded as a single piece or component. In other embodiments, the base 310 and the attachment adapter 325 may be molded as separate components and assembled to form a unitary piece. The base 310 and attachment adapter 325 may be molded or formed from any desirable material, including, for example, a resin material or a plastic material which may be molded using conventional molding techniques.

A valve 330 for a pump 300 according to various embodiments of the invention is illustrated in FIG. 11C. A valve 330 may include a valve stem 333, an outlet valve 339 at one end of the valve stem 333, and a valve disc 336 at an end of the valve stem 333 opposite the outlet valve 339. A valve rim 338 may circle or circumscribe a portion of the valve disc 336 or may be located anywhere desired on the valve disc 336. For example, as illustrated in FIG. 11C a valve rim 338 may be located on an outer rim of a valve disc 336.

A valve 330 according to various embodiments of the invention may be formed of any desired material. In some embodiments of the invention, the valve 330 may be a molded component. The valve 330 may be made of a flexible material or other moldable material. For example, the valve 330 may be made of silicon, a TPE material, or a TPU material.

A bellow 350 according to embodiments of the invention is illustrated in FIG. 11B. A bellow 350 may include a bellow dome 352, a bellow chamber 358, and a bellow rim 356. The bellow chamber 358 may be defined by the shape of the bellow dome 352. Different sizes and shapes of the bellow chamber 358 may be created by altering the shape or size of the bellow dome 352.

A bellow 350 may be formed of any desired material. In some embodiments of the invention, a bellow 350 may be a material that may be deformed but which will return to its original shape after a force causing such deformation is removed. For example, the bellow 350 may be made of silicon, a TPE material, or a TPU material. The bellow dome 352 may be deformed to change the volume or shape of the bellow chamber 358. As the bellow dome 352 is deformed, the remainder of the bellow 350 may flex or deform in a corresponding manner as desired.

A cap 380 according to various embodiments of the invention is illustrated in FIG. 11A. A cap 380 may include a cap flange 382. According to various embodiments of the invention, a cap 380 may be attachable to the base 310 or to another portion of a pump 300 to keep the various components of a pump 300 assembled. For example, the cap 380 illustrated in FIG. 11A may be positioned over a bellow 350 and a base 310 to secure the bellow 350 in an appropriate position with respect to the base 310. A cap 380 according to various embodiments of the invention may include any desired means for securing the cap 380 to the base 310 or other portion of the pump 300. For instance, the cap 380 may be screwed onto the base 310, may frictionally fit to the base 310, may be welded or glued to the base 310 or may be snapped onto the base 310. In various embodiments, the base 310 may include features which assist with the connection of the cap 380 to the base 310, such as corresponding lugs, screw channels, or other features needed to secure the cap 380 to the base 310.

Figure 12:
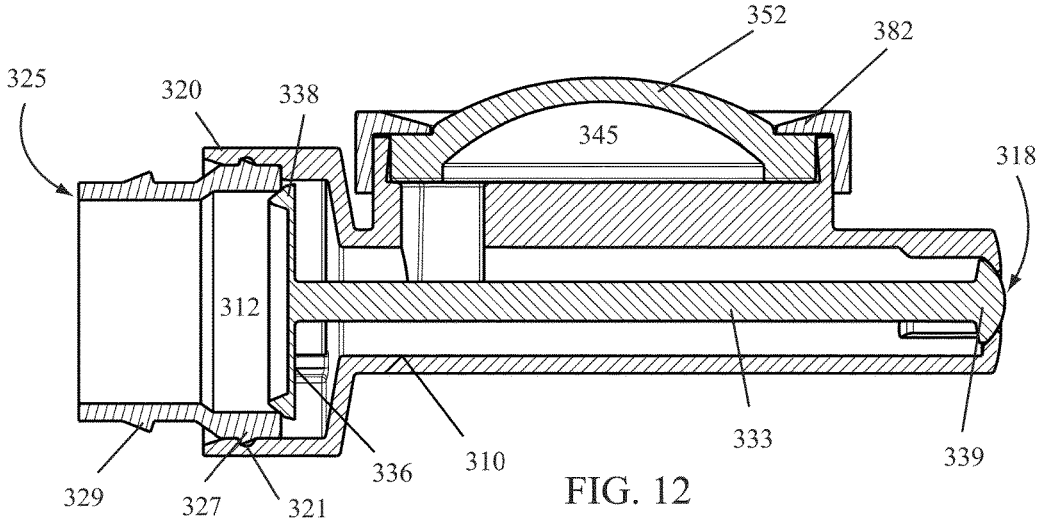
FIG. 12 illustrates a cross-sectional view of a pump according to various embodiments of the invention.

A pump 300 according to various embodiments of the invention may include a base 310, an attachment adapter 325, a valve 330, a bellow 350, and a cap 380 fitted together as illustrated in FIG. 12. According to embodiments of the invention, a valve 330 may fit within the interior chamber 314 of the base 310 such that the outlet valve 339 mates with the discharge passage 318 of the base 310. The outlet valve 339 may seal or close the discharge passage 318 when positioned in the interior chamber 314. The valve stem 333 may extend through the interior chamber 314 terminating in the valve disc 336 in the inlet passage 312. A portion of the attachment adapter 325, when assembled to the base 310, may contact a portion of the valve rim 338 of the valve disc 336 and may assist in positioning or holding the valve 330 in the base 310. As illustrated in FIG. 12, the attachment adapter 325 may be fitted to the base 310 such that the adapter attachment feature 327 fits with the attachment feature 321 of the base 310. Such attachment may secure the attachment adapter 325 to the base 310 and hold valve 330 within the interior chamber 314 of the base 310.

A bellow 350 may rest or be positioned on a portion of a base rim 322 as illustrated in FIG. 12. A bellow rim 356 may rest on a portion of the base 310 and on the base rim 322. According to embodiments of the invention, the bellow chamber 358 may be in communication with the interior chamber 314 of the base 310, thereby forming a pump chamber 345 when the bellow 350 is assembled to the base 310. A cap 380 or other securing mechanism fitted over a portion of the bellow 350 and the base 310 may hold the pump 300 together. For example, as illustrated in FIG. 12, the cap 380 may fit over the base 310 and the cap flange 382 may extend over a portion of the bellow rim 356. The cap 380 may be secured to the base 310 and the cap flange 382 may hold the bellow 350 in the desired position for the pump 300.

FIGS. 12 through 15 illustrate the operation of a pump 300 according to embodiments of the invention. As illustrated in FIG. 12, when the pump 300 is in a resting position, the pump chamber 345 is a closed volume defined by the bellow dome 352 and the interior chamber 314 of the base 310. The valve 330 positioned within the interior chamber 314 may seal both the inlet passage 312 and the discharge passage 318 of the pump 300.

Figure 13:
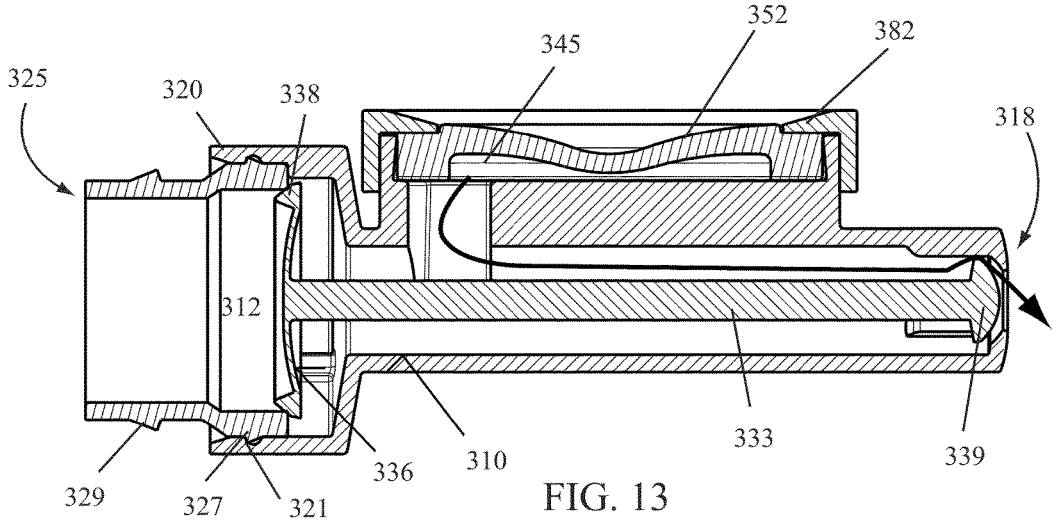
FIG. 13 illustrates a cross-sectional view of a pump according to various embodiments of the invention.

A force may be applied to the bellow dome 352 as illustrated in FIG. 13. When a force is applied to the bellow dome 352, the bellow dome 352 may be deformed as illustrated. The deformation of the bellow dome 352 alters the volume within the pump chamber 345. A product stored in the pump chamber 345 may be moved by such deformation. The valve disc 336 may be flexible such that when a force is applied to the product or the volume of the pump chamber 345 is altered, product may push on the valve disc 336 causing it to flex. Flexion of the valve disc 356 may move the valve stem 333 in the direction of the flexion and may cause the outlet valve 339 to disengage from the discharge passage 318, opening the discharge passage 318. When the discharge passage 318 is opened, product from within the pump chamber 345 may exit the pump 300 in the direction indicated by the arrow in FIG. 13.

Figure 14:
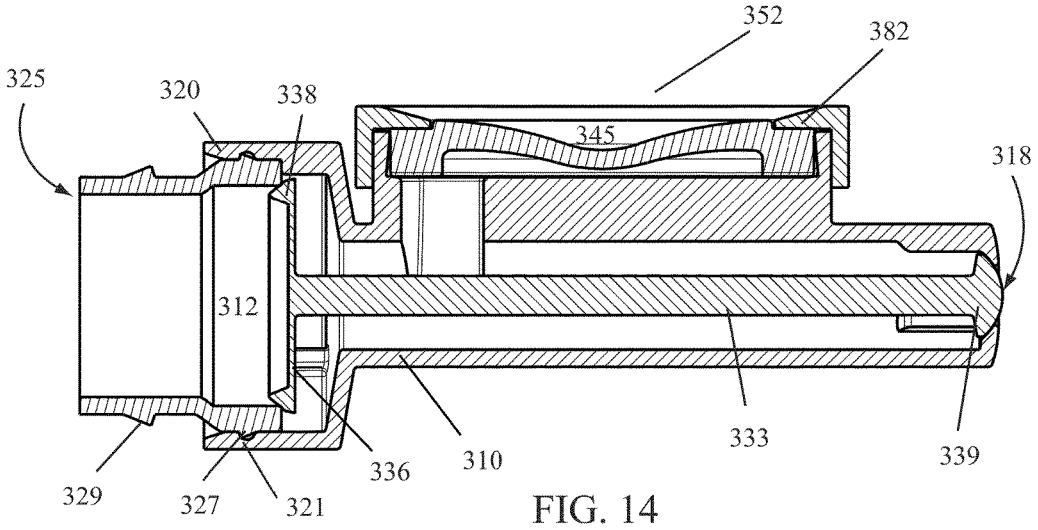
FIG. 14 illustrates a cross-sectional view of a pump according to various embodiments of the invention.

As illustrated in FIG. 14, when a force is removed from the bellow dome 352 or sufficient product in the pump chamber 345 has escaped the pump chamber 345, the valve disc 356 may return to its original position. Movement of the valve disc 356 to an original position may return the valve stem 333 to an original position which may close the outlet valve 339 and discharge passage 318.

Figure 15:
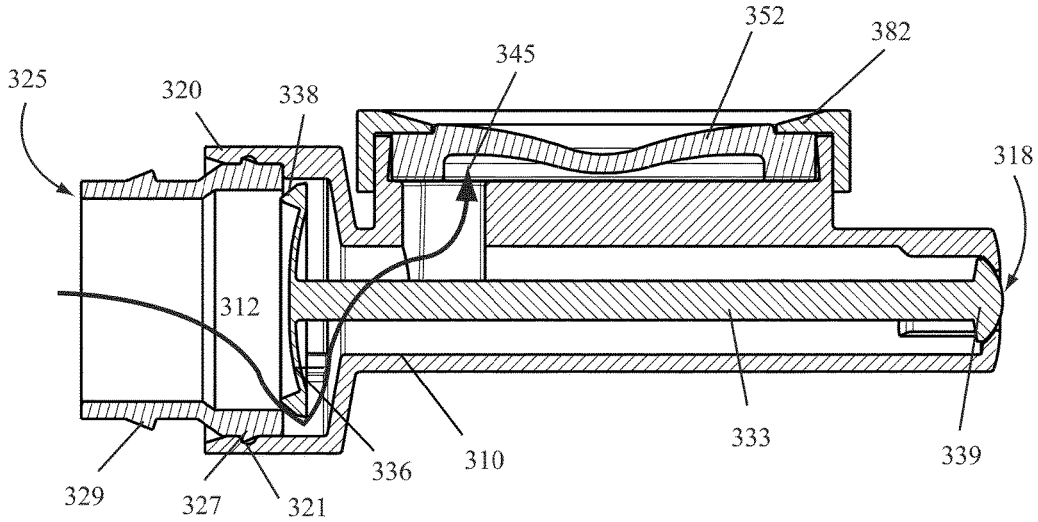
FIG. 15 illustrates a cross-sectional view of a pump according to various embodiments of the invention.

Following the release of the force on the bellow dome 352, the bellow dome 352 may begin to return to its original form or shape as illustrated in FIG. 15. As the bellow dome 352 retracts or moves back into its original position or shape, a vacuum may be formed within the pump chamber 345. The vacuum may act on the valve 330 such that the valve disc 356 flexes away from the inlet passage 312 and such that at least a portion of the contact between the valve rim 338 and the attachment adapter 325 is broken. Once the valve rim 338 is separated from contact with the attachment adapter 325, product from a container may flow through the inlet passage 312, past the valve rim 338 and valve disc 336 and into the pump chamber 345. In this manner, the pump chamber 345 may refill with product from the container. For example, product may flow from a container through the inlet passage 312 and into the pump chamber 345 along the path illustrated by the arrow in FIG. 15.

When the bellow dome 352 returns to its original shape or position, or when the vacuum force is insufficient to flex the valve disc 336, the valve rim 338 may again contact the attachment adapter 325 and form a seal between the valve 330 and the attachment adapter 325 as illustrated in FIG. 12.

As illustrated in FIGS. 12 through 15, a product may be pumped through the pump 300 by actuating the bellow dome 352 of the pump 300. When actuated, product in the pump chamber 345 may be forced out of the pump chamber 345 and through the discharge passage 318. In some instances, the product may follow the path illustrated in FIG. 13. Upon reducing or ceasing actuation of the bellow dome 352, the bellow dome 352 may return to its original position, drawing product from a container attached to the pump 300 through the inlet passage 312 and into the pump chamber 345. For example, product may enter the pump chamber 345 along the path illustrated in FIG. 15. In this manner, a pump 300 may be actuated to dispense a product from a container attached to the pump 300.

Examples of pumps 300 and pump devices utilizing pumps 300 according to various embodiments of the invention are illustrated in FIGS. 19 through 30.

Figure 19:
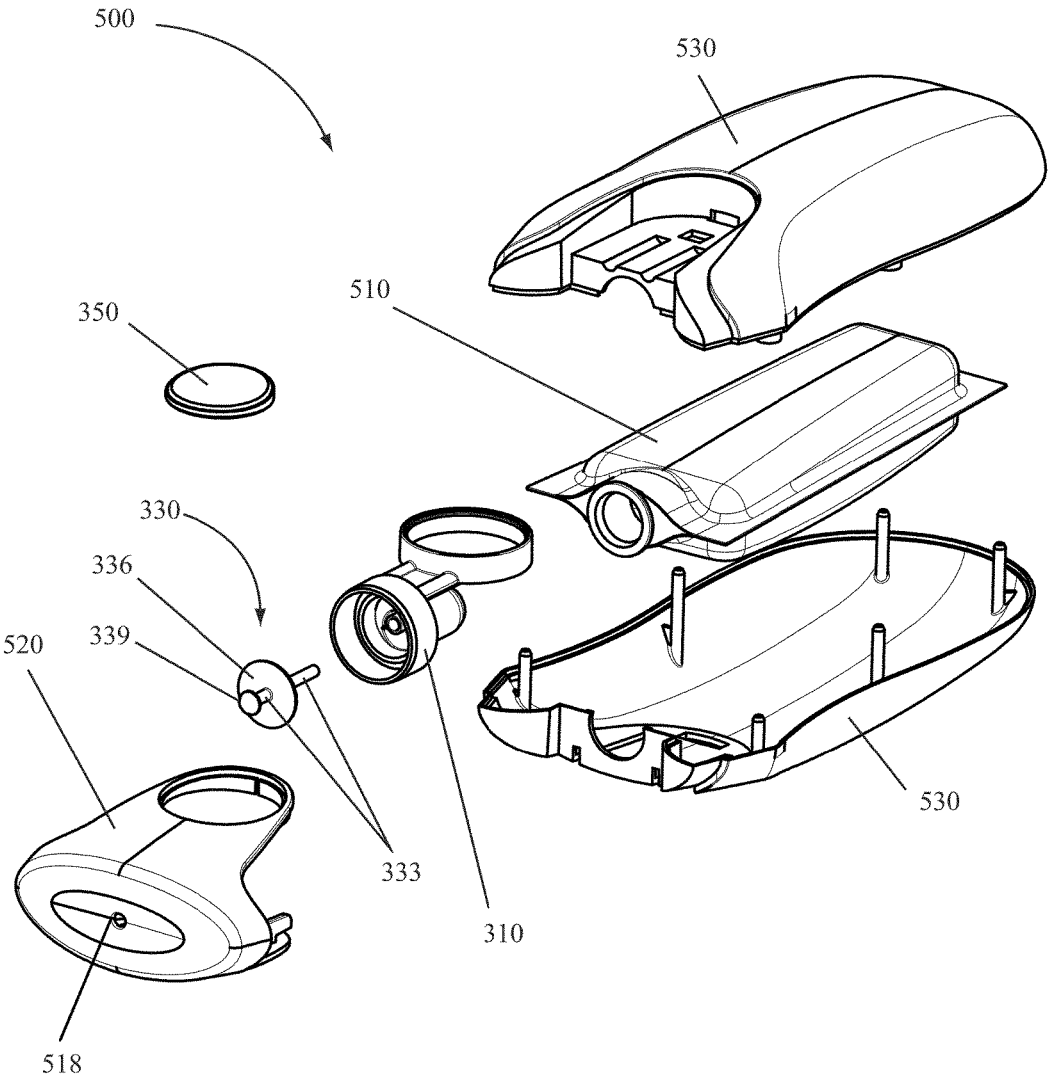
FIG. 19 illustrates a pump device utilizing a pump according to various embodiments of the invention.

A pump device 500 according to various embodiments of the invention is illustrated in FIG. 19. The pump device 500 may include a pump 300, a product container 510, a dispenser head 520, and at least one dispenser body part 530. The pump 300 may include a base 310, a valve 330, and a bellow 350.

According to embodiments of the invention, the pump 300 of the pump device 500 may be assembled by inserting the valve 330 into a portion of the base 310. The bellow 350 may also fit with the base 310. The dispenser head 520 may mate with the base 310 and may act as a cap, sealing or holding the bellow 350 in communication with the base 310. In addition, the dispenser head 520 may include a discharge passage 518 which substitutes for the discharge passage of the pump 300 illustrated in FIG. 11D. In this manner, the valve 330 of the pump device 500 mates with the discharge passage 518 of the dispenser head 520 to seal and open the discharge passage from the pump 300.

The valve 330 according to embodiments of the invention may also differ from the valve 330 illustrated in FIG. 11C in that the valve disc 336 need not be located at an end of the valve stem 333 opposite the outlet valve 339. Instead, according to various embodiments of the invention, the valve disc 336 may be located any where along a valve stem 333 as desired. For example, as illustrated in FIG. 19, the valve disc 336 may be located near the outlet valve 339 and a portion of the valve stem 333 may extend beyond the valve disc 336. According to some embodiments of the invention, the valve stem 333 may extend beyond either the valve disc 336 or the outlet valve 339 as desired to promote the operation of a pump 300 according to embodiments of the invention. According to some embodiments, a portion of the valve stem 333 extending beyond a valve disc 336 may mate with or be fitted into an opening in a base 310 to retain, support, or fit the valve 330 in a proper position within the base 310.

The assembly of the discharge head 520 and pump 300 may be fitted to or mated with a product container 510 such as a pouch, bag, bottle, or other container. Further, one or more dispenser body parts 530 may be fitted to the discharge head 520 to enclose, contain, or otherwise support the product container 510 and pump 300. For example, as illustrated in FIG. 19, two dispenser body parts 530 may be snapped or otherwise fitted together and combined with the discharge head 520 to form a pump device 500.

Figure 20:
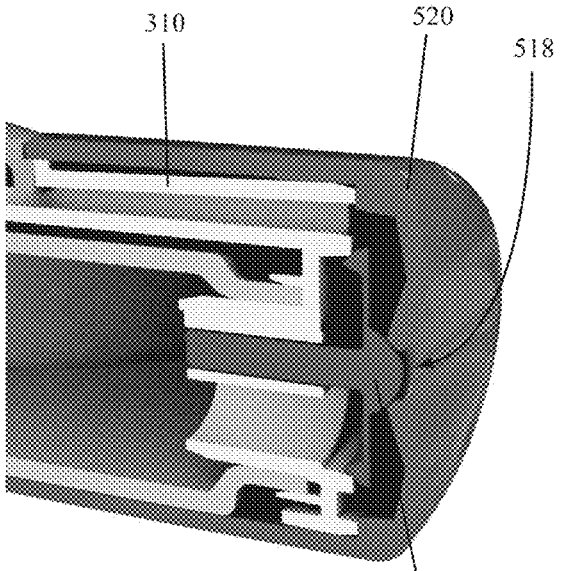
FIG. 20 illustrates a cross-sectional view of a pump device according to embodiments of the invention.
Figure 21:
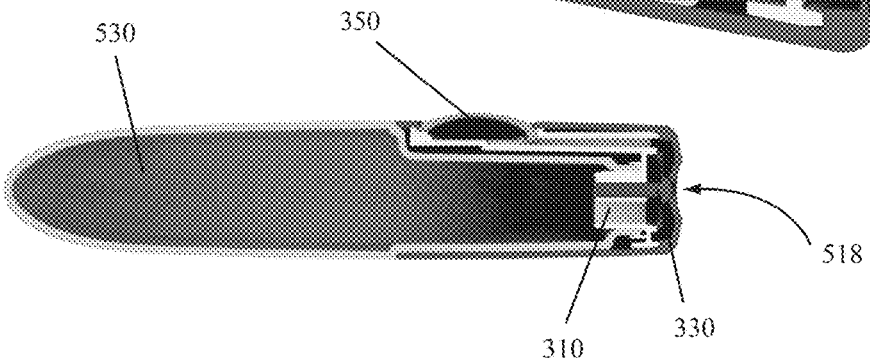
FIG. 21 illustrates a cross-sectional view of a pump device according to embodiments of the invention.
Figure 22:
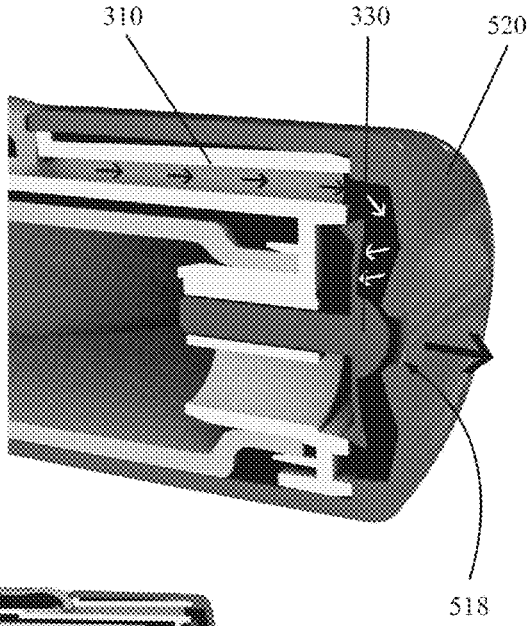
FIG. 22 illustrates a cross-sectional view of a pump device according to embodiments of the invention.
Figure 23:
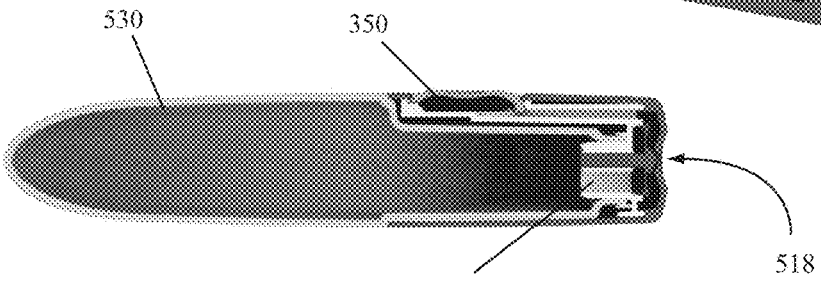
FIG. 23 illustrates a cross-sectional view of a pump device according to embodiments of the invention.
Figure 24:
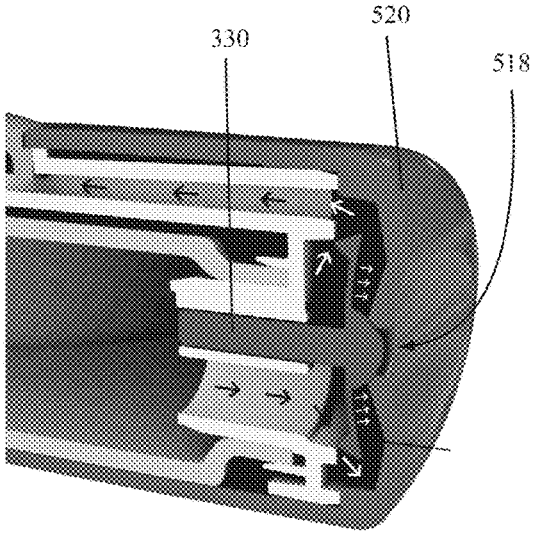
FIG. 24 illustrates a cross-sectional view of a pump device according to embodiments of the invention.
Figure 25:
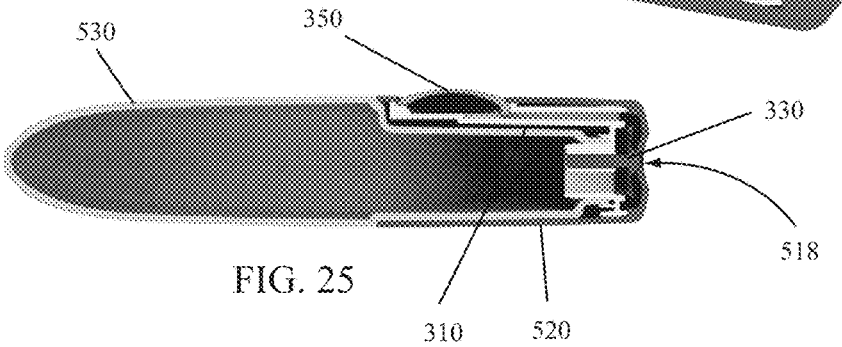
FIG. 25 illustrates a cross-sectional view of a pump device according to embodiments of the invention.

A pump device 500 such as that illustrated in FIG. 19 is illustrated in FIGS. 20 through 25. As illustrated in FIGS. 20 and 21, the pump 300 of the pump device 500 is at rest. When at rest, the valve 330 may seal against the discharge passage 518 of the dispenser head 520 such that product or fluid cannot exit the interior of the discharge head 520. As illustrated in FIG. 23, when the bellow 350 of the pump 300 is depressed and the pressure of the fluid being forced from the bellow 350 acts on the valve 330 and disengages the outlet valve 339 from the discharge passage 518 in the discharge head 520, allowing product from within the bellow 350 to flow out of the pump device 500 as illustrated in FIG. 22. When the force or pressure on the bellow 350 is released as illustrated in FIG. 25, the bellow 350 creates a vacuum pressure which draws product or fluid from the container into the base 310, past the valve 330 and into the bellow 350 chamber and base 310 portion of the pump 300 as illustrated in FIG. 24. The release of the pressure on the bellow 350 also allows the valve 330 to relax and reseal the outlet valve 339 with the discharge passage 518 such that product or fluid is not released from the pump device 500.

Figure 26:
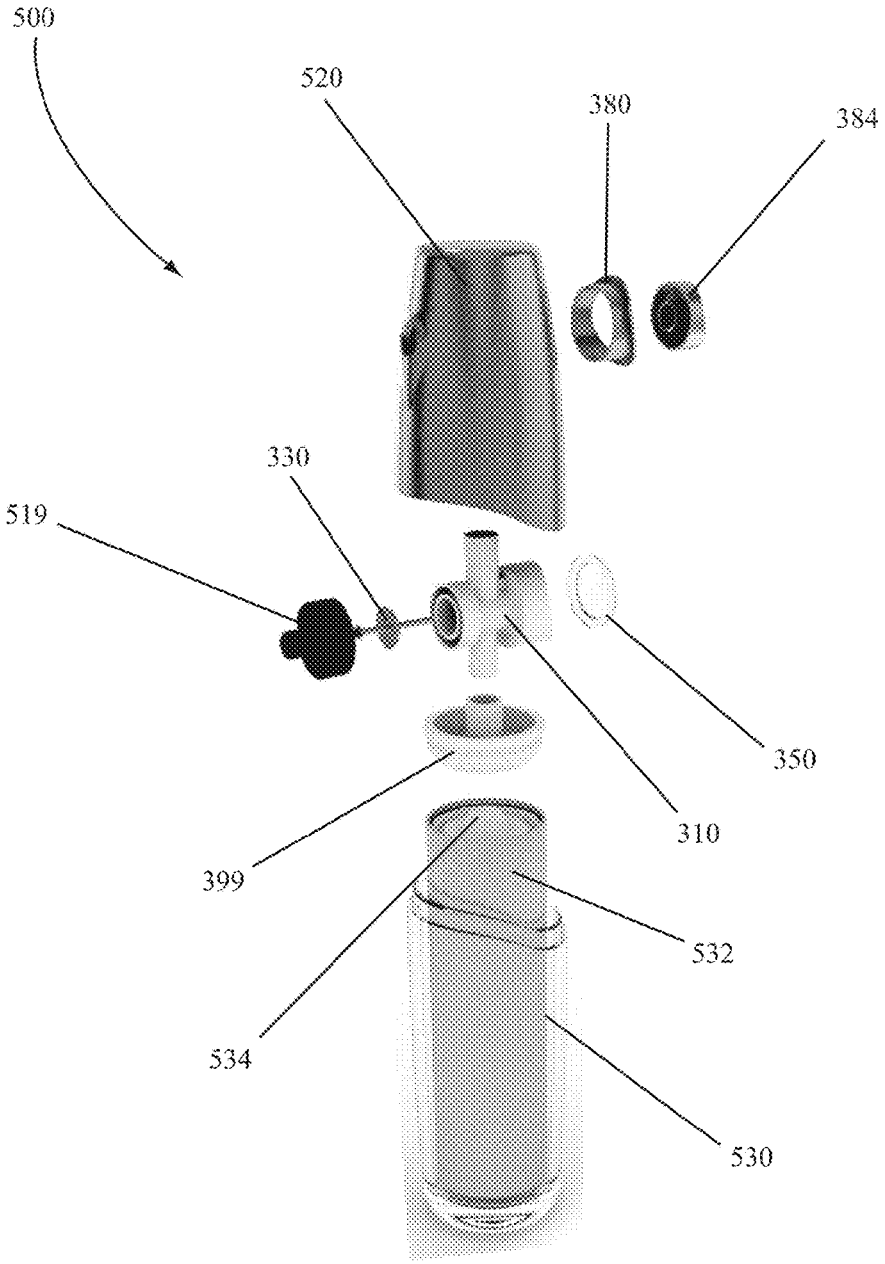
FIG. 26 illustrates a pump device utilizing a pump according to various embodiments of the invention.

Another example of a pump device 500 according to embodiments of the invention is illustrated in FIG. 26. The pump device 500 may include a pump 300 according to embodiments of the invention contained within a discharge head 520 which may be fitted to or mated with a body part 530. The body part 530 may be a bottle as illustrated. A pouch, bottle, bag, tube or other container 532 may be contained within the body part 530 and attached to the pump 300. In some embodiments, a container 532 may include a bottle for delivery of a product by an airless method which may include the use of a follower piston 534 as illustrated in FIG. 26.

A pump device 500 may also include a container connection 399 which fits to the base 310 of the pump 300 and allows attachment to the container 532 or to a body part 530. A discharge connection 519 may be fitted to the base 310 of the pump 300 with a valve 330 seated between the base 310 and the discharge connection 519. The discharge connection 519 may act as a discharge passageway and the outlet valve 339 of the valve 330 may seal against an interior portion of the discharge connection 519. The bellow 350 may be fitted or secured to the base 310 using the cap 380 and the bellow 350 may extend through an opening in the discharge head 520. In some embodiments, a button 384 may also be secured or fitted with the cap 380 or cap 380 and bellow 350 such that the button 384 may be pressed to actuate the bellow 350 instead of a user pressing directly on the bellow 350.

Figure 27:
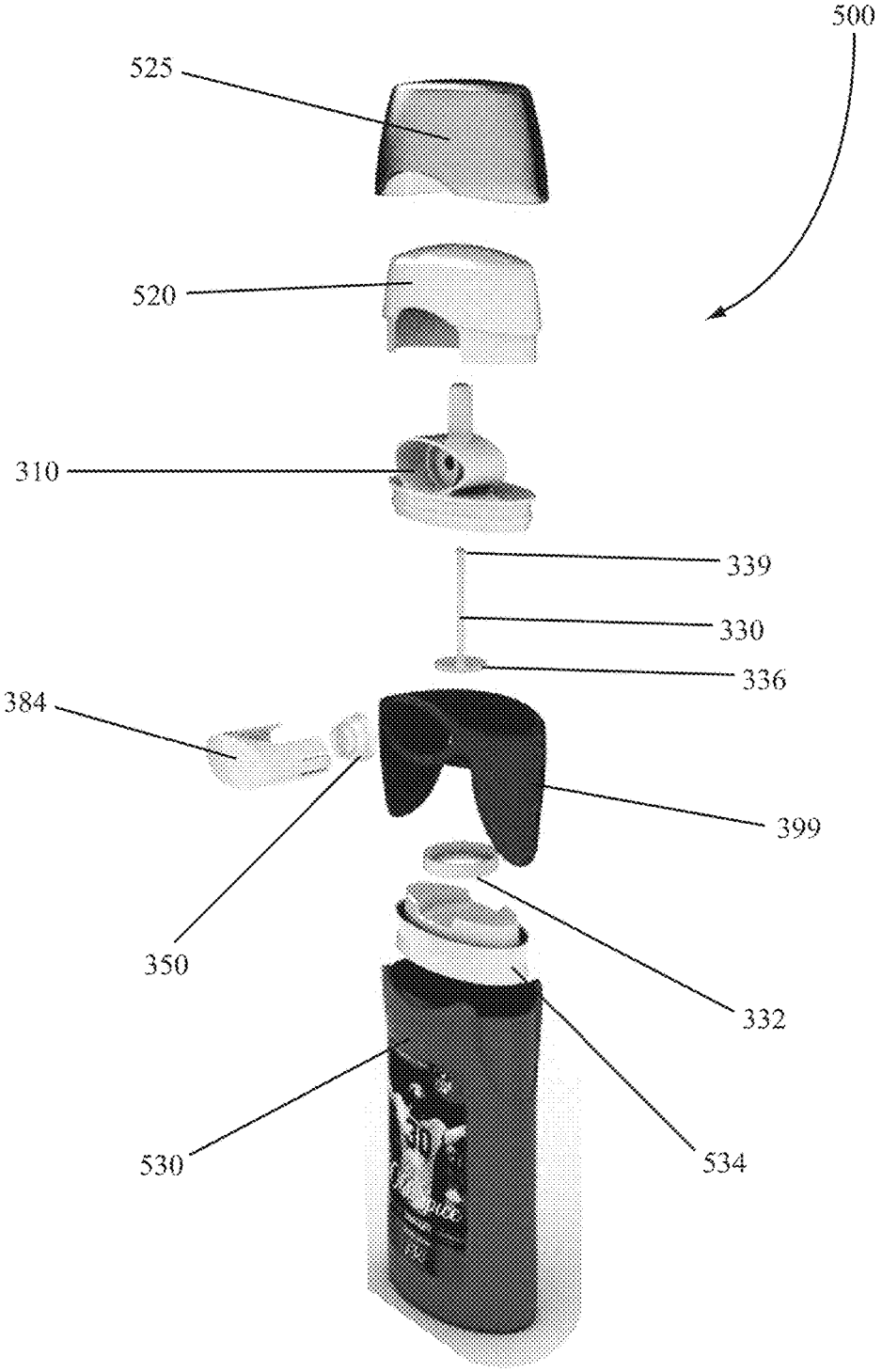
FIG. 27 illustrates a pump device utilizing a pump according to various embodiments of the invention.

Another example of a pump device 500 utilizing a pump 300 according to embodiments of the invention is illustrated in FIG. 27. As illustrated, the pump device 500 may include a body part 530 for housing a product or a container holding a product, a container connection 399, container connection 399, a discharge head 520, and a device cap 525. A pump 300 contained in the pump device 500 may include a button 384 connected to or in communication with a bellow 350 and fitted in the container connection 399. A valve 330 and base 310 may also be partially fitted in the container connection 399 and in communication with the bellow 350. A valve seat 332 may also be assembled with the pump 300 and fitted to the container connection 399 to provide a seat for the valve disc 336 of the valve 330. The discharge head 520 may be fitted to or with the base 310, with the container connection 399, or with both the base 310 and the container connection 399. An outlet valve 339 associated with the valve 330 may seal against an interior portion of the discharge head 520. Product may be pumped from the body part 530 or a container in the body part 530 by actuation of the button 384 which may actuate the bellow 350 and move the valve 330 according to embodiments of the invention.

Figure 28:
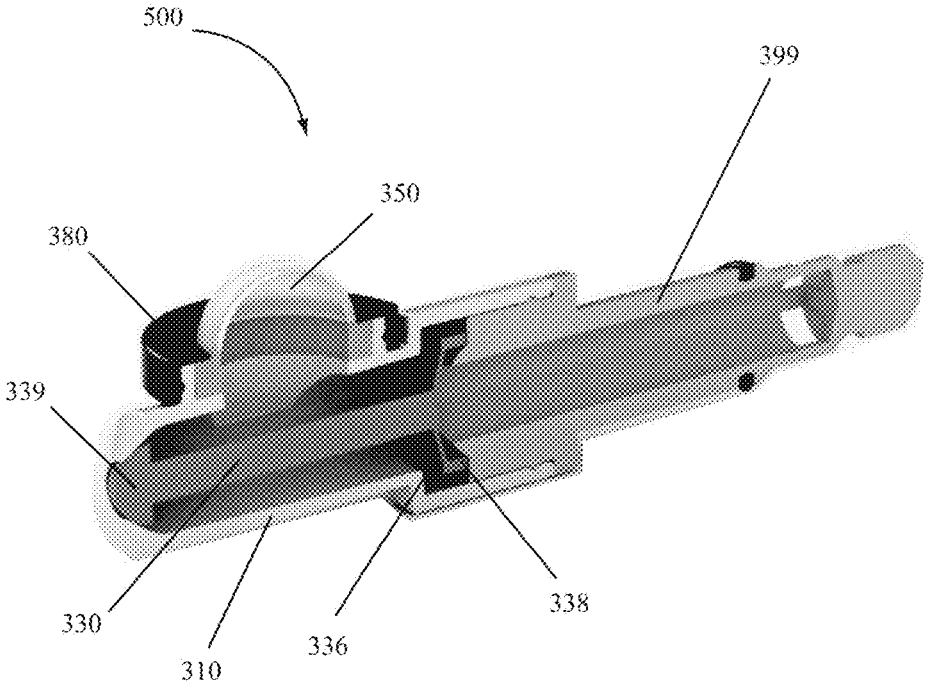
FIG. 28 illustrates a cross-sectional view of a pump device utilizing a pump according to various embodiments of the invention.
Figure 29:
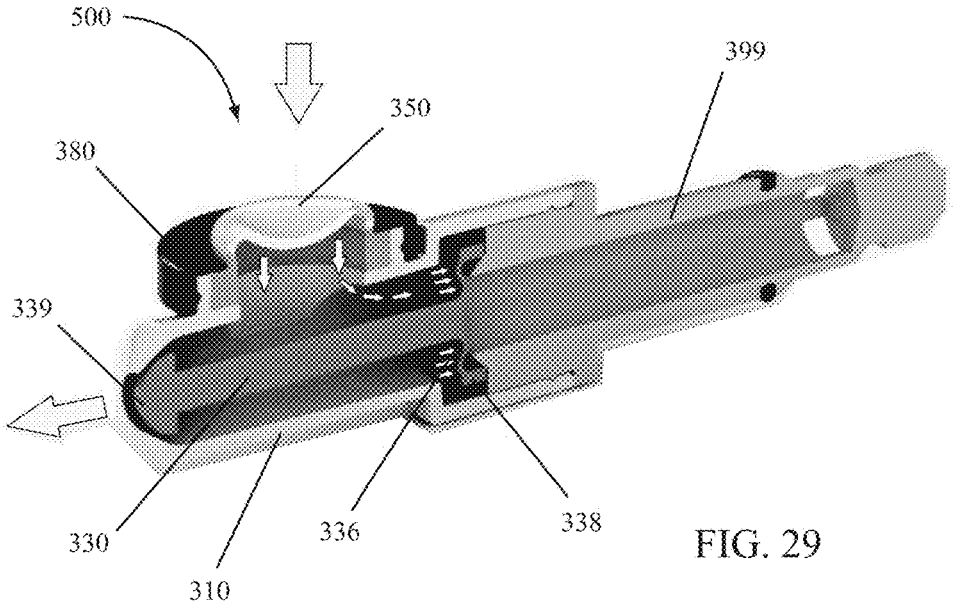
FIG. 29 illustrates a cross-sectional view of a pump device according to embodiments of the invention.
Figure 30:
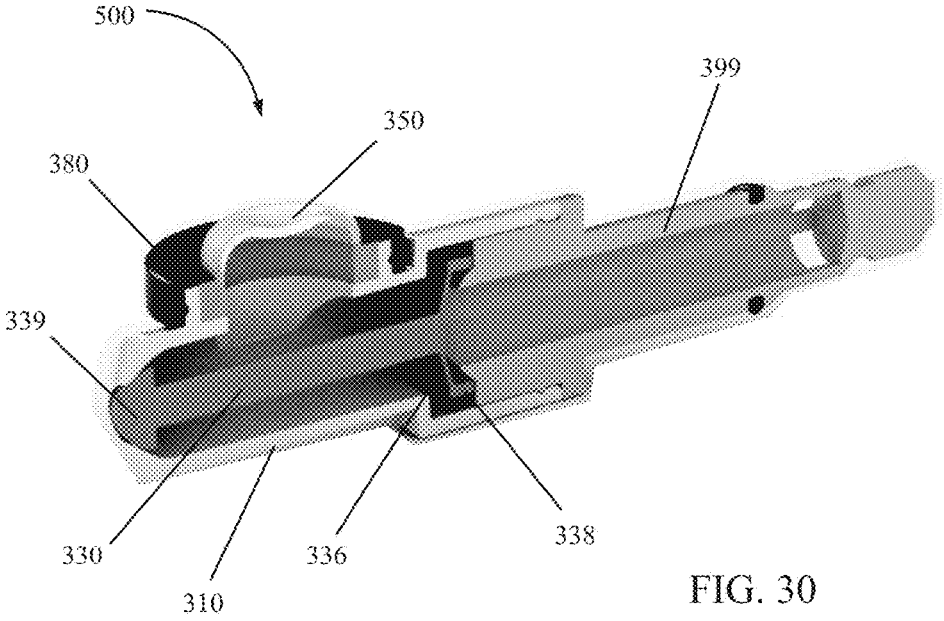
FIG. 30 illustrates a cross-sectional view of a pump device according to embodiments of the invention.

A further example of a pump device 500 according to embodiments of the invention is illustrated in FIGS. 28 through 30. FIG. 28 illustrates a cross-sectional view of a pump device 500 at rest. The pump device 500 may include a container connection 399 snap-fit, screwed, or otherwise connected to a base 310 of a pump 300. The base 310 may include an opening in which a bellow 350 rests or sits. A cap 380 or other means may be used to fix the bellow 350 against the base 310 or hold the bellow 350 in position. While a cap 380 is illustrated in FIGS. 28 through 30 it is understood that other fixation means may be used. For example, the bellow 350 may be glued, welded, spiked, snapped, frictionally fit, or otherwise fitted to the base 310. A valve 330 may be fitted within at least a portion of the interior of the base 310 and an outlet valve 339 portion of the valve 330 may abut up against an opening in the base 310 such that the outlet valve 339 seals against the opening in the base 310, preventing material on an interior of the base 310 from passing through the opening. A valve disc 336 at an opposite end of the valve 330 from the outlet valve 339, may include one or more valve rims 338. In some embodiments, the valve rim 338 may include a circumferential projection extending from the valve disc 336 towards the container connection 399. In some embodiments of the invention, the container connection 399, when assembled with the base 310, may press against or abut the one or more valve rims 338 such that the contact between the one or more valve rims 338 with the container connection 399 forms a valve. In other embodiments of the invention, the one or more valve rims 338 may press against or abut one or more projections integral with the base 310 such that such contact between the base 310 and the one or more valve rims 338 forms a valve.

During operation of the pump device 500 illustrated in FIG. 28, fluid or product may be drawn from a container connected to the container connection 399, past the valve disc 336 into an interior portion of the base 310. Upon actuation of the bellow 350, product within an interior portion of the base 310 may be ejected through an opening in the base 310 once the outlet valve 339 is moved.

For example, the pump device 500 illustrated in FIG. 29 is undergoing actuation. As bellow 350 is pressed, a force is applied to the product contained within the base 310. The force on the product contained within the base 310 acts against the valve disc 336. As the valve disc 336 is deformed, the deformation moves the outlet valve 339 off of its seat with an opening in the base 310. Product within the base 310 may then escape or flow out of the opening until the forces applied to the bellow 350 are insufficient to continue to deform the valve disc 336 at which time the outlet valve 339 reseats on the opening in the base 310, sealing the outlet. During the deformation of the valve disc 336, the one or more valve rims 338 are sealed against the container connection 399 preventing the backflow of fluid or product past the valve disc 336 into the container connection 399.

As illustrated in FIG. 30, the filling of the base 310 with product from a container connected through the container connection 399 occurs. Once the bellow 350 has been actuated and the force being applied is stopped, the bellow 350 retracts back to its original shape. During the retraction, vacuum forces are created which deform the valve disc 336 in an opposite direction, disengaging the valve rim 338 from contact with the container connection 399. Product or fluid from the container may then be drawn into an interior portion of the base 310 and bellow 350 past the opening between the valve rim 338 and container connection 399. The flow of product refills the base 310 so that the pump device 500 is ready to dispense the product again.

According to still other embodiments of the invention, a pump device 600 may include a valve 330 according to embodiments of the invention incorporated with a traditional pump. For example, a pump device 600 employing a valve 330 according to embodiments of the invention is illustrated in FIGS. 31 through 33. A traditional pump, such as a pump assembly illustrated and described in U.S. Pat. No. 7,793,803, which is incorporated herein by reference in its entirety, may be fitted with a valve 330 according to embodiments of the invention.

As illustrated in FIGS. 31 through 33, an upper part of the pump or pump cap 610 may include a discharge opening 612. A valve 330 according to embodiments of the invention may be inserted into the discharge opening 612 with an orifice cup 614 having an opening for discharging fluid. The outlet valve 339 portion of the valve 330 may mate with or seal to the opening in the orifice cup 614. The valve disc 336 may contact a portion of the discharge opening 612 or other projection in the pump cap 610. The valve 330 may move as product is pumped through the pump device 600.

For example, the pump device 600 illustrated in FIG. 31 is at rest. As the pump device 600 is pumped, fluid or product flows through the pump device 600 and into the orifice cup 614. As fluid pressure builds up within the orifice cup 614, the pressure acts on the valve 330 and deforms the valve disc 336 such that the deformation unseats the outlet valve 339 from contact with the opening in the orifice cup 614 as illustrated in FIG. 32. The movement of the outlet valve 339 allows product to flow from the pump device 600. Once the pressure in the pump device 600 decreases, the valve disc 336 returns to its original position and reseals the outlet valve 339 to the opening in the orifice cup 614 as illustrated in FIG. 31. The valve 330 can therefore be used to seal a pump device 600. According to some embodiments of the invention, the seal between the outlet valve 339 and the opening in the orifice 614 may be airtight such that the product in the pump device 600 is protected from exposure to the air or environment in which it is kept.

A pump device 600 utilizing a valve 330 according to embodiments of the invention is illustrated in FIG. 33. The pump device 600 may be assembled by inserting a valve 330 and orifice cup 614 into the discharge opening 612 of the pump cap 610.

Figure 34:
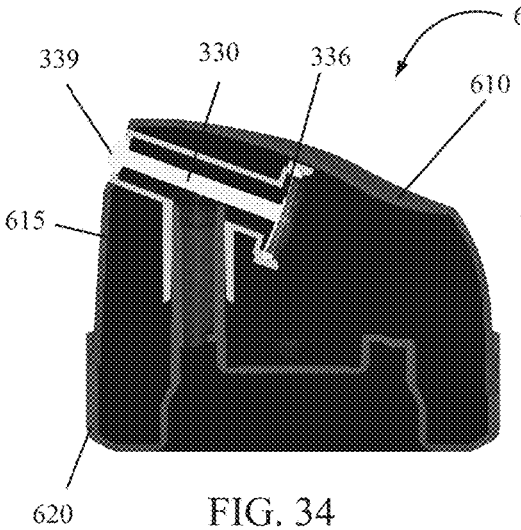
FIG. 34 illustrates a cross-sectional view of a pump device according to embodiments of the invention.
Figure 35:
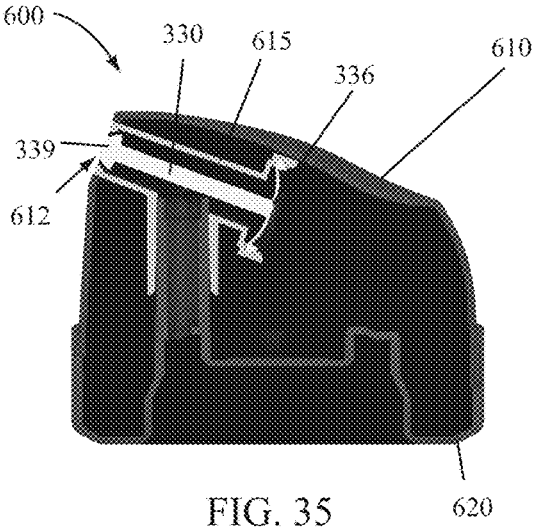
FIG. 35 illustrates a cross-sectional view of a pump device according to embodiments of the invention.
Figure 36:
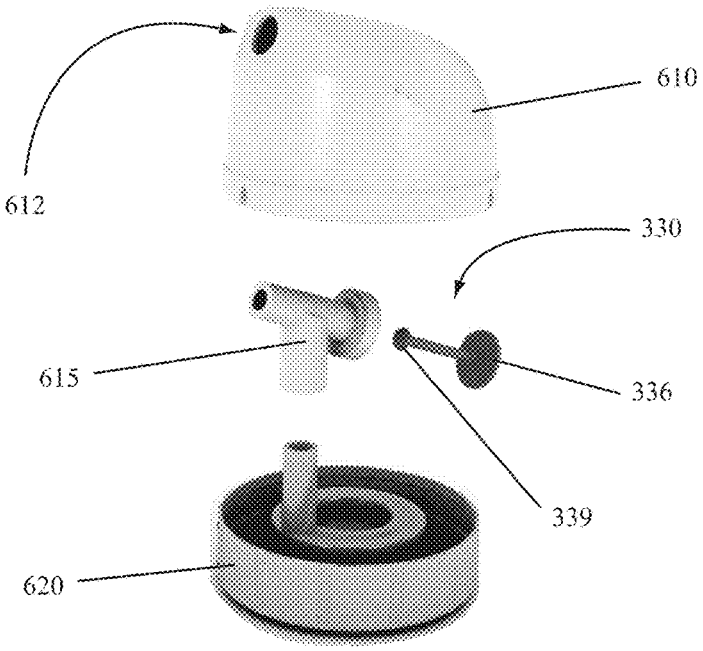
FIG. 36 illustrates a blown-apart view of a pump device according to embodiments of the invention.

According to other embodiments of the invention, a pump device 600 may be assembled as illustrated in FIG. 36. A pump base 620 may be assembled to an orifice adapter 615 having a valve 330 according to embodiments of the invention assembled therein. A pump cap 610 may be fitted to the pump base 620 and the orifice adapter 615 may be aligned such that an opening in the orifice adapter 615 is aligned with the discharge opening 612 in the pump cap 610. Operation of the pump device 600 is illustrated in FIGS. 34 and 35. At rest, the valve 330 is not stressed and the outlet valve 339 seals against an opening in the orifice adapter 615 as illustrated in FIG. 34. Once fluid or product is pumped through the pump device 600, the valve 330 is stressed such that the valve disc 336 flexes, unseating the outlet valve 339 from the opening in the orifice adapter 615 and allowing fluid to pass as illustrated in FIG. 35. Once the pump stroke is complete, the valve 330 is unstressed and the outlet valve 339 may seal against the opening in the orifice adapter 615.

The pumps according to various embodiments of the invention have been described as being made of certain materials. It is understood that other materials may be substituted or interchanged with various embodiments of the invention to provide pumps having different material characteristics as desired.

Further, the pumps according to various embodiments of the invention may be attached to or otherwise in communication with a container. It is understood that a container may include any receptacle which may be used to hold a product, including, but not limited to, bottles, bags, pouches, sachets, airless systems, tubes and other devices.

While various embodiments of the invention have been described with respect to pumps or pump devices used in the personal and beauty care markets, it is understood that the pumps of various embodiments of the invention may be used in other fields and/or markets and that such pumps may be scaled up or down as desired to meet the requirements of any desired pump specifications.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A pump device, comprising:

a base having an inlet opening and an outlet opening;

an attachment adapter fitted to the inlet opening of the base;

an elastomeric molded valve fitted within an interior chamber of the base between the attachment adapter and the outlet opening, wherein the valve comprises;

a valve stem;

an outlet valve on one end of the valve stem, said outlet valve being seated with and sealed against the outlet opening in the base when the pump device is at rest;

a flexible valve disc on an end of the valve stem opposite the outlet valve;

at least one valve rim positioned on the valve disc on a side opposite the outlet valve being seated with and sealed against the attachment adapter when the pump device is at rest; and a domed bellow in communication with at least a portion of the interior chamber of the base.

2. The pump device of claim 1, further comprising a container connected to the attachment adapter.

3. The pump device of claim 1, wherein the elastomeric molded valve comprises a material selected from the group consisting of silicone, thermoplastic elastomer, and thermoplastic urethane.

4. The pump device of claim 1, wherein the domed bellow comprises a material selected from the group consisting of silicone, thermoplastic elastomer, and thermoplastic urethane.

5. The pump device of claim 1, further comprising a product in the interior chamber, wherein deformation of the bellow applies a discharge force to the product, flexing the valve disc toward the inlet, unseating the outlet valve from the discharge passage, and maintaining the sealing of the attachment adapter with the at least one valve rim, and wherein subsequent release of the bellow applies a suction force to the product, flexing the valve disc toward the outlet, unseating the valve rim from the attachment adapter, and maintaining the sealing of the outlet valve with the outlet opening.

* * * * *